US009622318B2

(12) United States Patent
Brainard

(10) Patent No.: US 9,622,318 B2
(45) Date of Patent: Apr. 11, 2017

(54) LENSED CABLE LIGHT SYSTEMS

(71) Applicant: Light Media Industries, LLC, Deland, FL (US)

(72) Inventor: David K. Brainard, Palm Coast, FL (US)

(73) Assignee: Light Media Industries, LLC, Deland, FL (US)

( * ) Notice: Subject to any disclaimer, the term of this patent is extended or adjusted under 35 U.S.C. 154(b) by 26 days.

(21) Appl. No.: 14/745,229

(22) Filed: Jun. 19, 2015

(65) Prior Publication Data

US 2015/0289342 A1 Oct. 8, 2015

Related U.S. Application Data

(63) Continuation of application No. 13/653,922, filed on Oct. 17, 2012, now Pat. No. 9,062,860, which is a (Continued)

(51) Int. Cl.
*H05B 33/10* (2006.01)
*F21V 13/04* (2006.01)

(Continued)

(52) U.S. Cl.
CPC ..... *H05B 33/10* (2013.01); *F21V 5/04* (2013.01); *F21V 13/04* (2013.01); *G09F 13/22* (2013.01);

(Continued)

(58) Field of Classification Search
CPC . F21V 5/04; F21V 13/04; H05B 33/10; H01L 51/5287; G09F 13/22
See application file for complete search history.

(56) References Cited

U.S. PATENT DOCUMENTS 3,819,973 A * 6/1974 Hosford ..... H05B 33/26 313/345
6,190,027 B1 * 2/2001 Lekson ..... B60Q 1/323 313/512

(Continued)

OTHER PUBLICATIONS

International Search Report and Written Opinion of the International Search Authority received in Patent Cooperation Treaty Application No. PCT/US2009/069935, dated Aug. 11, 2010, 9 pages.

(Continued)

*Primary Examiner* — Anne Hines
(74) *Attorney, Agent, or Firm* — Spencer C. Patterson; Grable Martin Fulton PLLC

(57) ABSTRACT

A light assembly includes an electroluminescent cable, an elongated lens, and a substantially planar substrate. The electroluminescent cable has an outer surface extending along a longitudinal dimension of the electroluminescent cable. The elongated lens extends along the longitudinal dimension of the electroluminescent cable and encloses at least a portion of the outer surface of the electroluminescent cable. The elongated lens is adapted to refract light emitted from the electroluminescent cable. The elongated lens structure is adhered to the substantially planar substrate. In certain instances, the substrate is a reflective substrate adapted to reflect light emitted from the electroluminescent cable.

10 Claims, 18 Drawing Sheets

Related U.S. Application Data continuation of application No. 12/650,173, filed on Dec. 30, 2009, now abandoned.

(60) Provisional application No. 61/153,694, filed on Feb. 19, 2009, provisional application No. 61/142,189, filed on Dec. 31, 2008.

(51) Int. Cl.

| | |
|---|---|
| ***G09F 13/22*** | (2006.01) |
| ***F21V 5/04*** | (2006.01) |
| *F21Y 103/00* | (2016.01) |
| *F21Y 115/20* | (2016.01) |

(52) U.S. Cl.

CPC ..... *F21Y 2103/00* (2013.01); *F21Y 2115/20* (2016.08); *Y10T 156/10* (2015.01); *Y10T 156/1026* (2015.01)

(56) References Cited

U.S. PATENT DOCUMENTS

| | | | | |
|---|---|---|---|---|
| 2002/0130624 | A1* | 9/2002 | Nakamura | D02G 3/441 315/56 |
| 2007/0042168 | A1 | 2/2007 | Harada et al. | |
| 2008/0036375 | A1 | 2/2008 | Zheng | |
| 2008/0265767 | A1* | 10/2008 | Baumberg | C09K 11/584 313/511 |
| 2010/0226116 | A1* | 9/2010 | Brainard | F21V 13/04 362/84 |

OTHER PUBLICATIONS

International Preliminary Report on Patentability received in Patent Cooperation Treaty Application No. PCT/US2009/069935, dated Jul. 14, 2011, 6 pages.

* cited by examiner

LENSED CABLE LIGHT SYSTEMS

CROSS-REFERENCE TO RELATED APPLICATIONS

The present application is a continuation of U.S. patent application Ser. No. 13/653,922 filed Oct. 17, 2012, which is a continuation of U.S. patent application Ser. No. 12/650,173 filed Dec. 30, 2009, which claims the benefit of U.S. Provisional Application No. 61/142,189, filed Dec. 31, 2008 and U.S. Provisional Application No. 61/153,694, filed Feb. 19, 2009, the entire disclosures of which are incorporated by reference herein.

TECHNICAL FIELD

This description relates to lighting assemblies, specifically orientable, low power lighting systems.

BACKGROUND

Marketers of services and products within competitive markets look to high-impact advertising solutions to help consumers identify and remember their product or service. Large, illuminated billboards have long been used as a popular form of high impact advertising, as well as the decades-old neon sign, popularized within bars and restaurants as advertisements for beer and other spirits. Modern advertisers, facing highly media-driven and technology-centric markets, have the challenge of identifying and implementing new and eye-catching alternatives in crafting their message and presentation. For instance, some advertisers have turned to the use of large, ornate props and comedic statues in connection with their billboard to catch the attention of potential viewers. Other media providers have turned to large, LCD video billboards to differentiate from the typical billboard and grab the attention of viewers.

Another form of advertising that currently grows in popularity, is the integration of advertisements with vehicles. Not unlike the banners and sky writing performed by aircraft in past decades, this allows advertisers to physically bring their message to their targeted market, whether it be a particular neighborhood, venue, or special event. Billboard trucks are one such form of mobile advertising. Another popular form of advertising are vehicle wraps on fleet vehicles that effectively print a billboard on the surface of an automobile. When combined with a unique, popular, or eye-catching automobile model, vehicle wraps can be used to maximum "head turning" effect.

Another technique used by advertisers to increase the visibility and impact of advertisement is the use of light. Night-lit billboards have been available for the better part of a century. Other modern billboards and window posters use light, such as back-lit video presentations, LEDs, and incandescent lighting to achieve high-impact effects. Creating a high-impact lighting presentation can be useful outside of advertising as well, including use in connection with emergency vehicles and safety products that need to quickly and effectively alert and grab the attention of the public. Many of these lighting solutions, within advertising and safety products, however, do not meet the desires of a market increasingly sensitive to the energy efficiency of their products and business practices. Additionally, some lighting solutions are limited in their application due to their weight, heat emission, fragility, cost, and bulk. For instance, traditional incandescent lamps and LEDs have to be used with caution because they tend to protrude from the surface of the product and may be easily damaged. In addition to this, some solutions using incandescent lights, neon lights and LEDs are bulky, heavy and produce unsuitable levels of excess heat. These deficiencies can cause some lighting solutions to be poor candidates for use in popular mobile or portable applications. Additionally, some of these conventional light sources are also prone to failure due to short operational life spans, or because they are not shockproof or water resistant, limiting their application to indoor or sheltered environments.

SUMMARY

In one general aspect, a light assembly includes an electroluminescent cable, an elongated lens, and a substantially planar substrate. The electroluminescent cable has an outer surface extending along a longitudinal dimension of the electroluminescent cable. The elongated lens extends along the longitudinal dimension of the electroluminescent cable and encloses at least a portion of the outer surface of the electroluminescent cable. The elongated lens is adapted to refract light emitted from the electroluminescent cable. The elongated lens structure is adhered to the substantially planar substrate.

Implementations can include one or more of the following features. The substrate can be a reflective substrate adapted to reflect light emitted from the electroluminescent cable. The substrate can be the surface of at least one of a sign, traffic sign, automobile, bicycle, shoe, billboard, watercraft, article of clothing, toy, or placard. The light assembly can be adapted to emit light at a substantially 180 degree viewing angle. The light assembly can include a transparent protective sheath disposed around the electroluminescent cable. The electroluminescent cable and elongated lens can be flexible and capable of being formed into a continuous, non-linear orientation. For instance, the electroluminescent cable and elongated lens can be oriented to form at least one of a letter, number, word, shape, or image.

In some aspects, the electroluminescent cable can include a first electrode, a second electrode disposed so as to create an electromagnetic field between the first and second electrodes when a voltage is applied to the first and second electrodes, and an electroluminescent core disposed between the first and second electrodes and adapted to emit light when excited by the electromagnetic field. The electroluminescent core can include an electroluminphor powder and dielectric binding. The electroluminescent core can be an electrobioluminscent core. The electroluminescent cable can include a plurality of electroluminescent cores, a first core in the plurality of cores adapted to emit light of a first color and a second core in the plurality of cores adapted to emit light of a second color.

In some aspects, the elongated lens can have dimensions adapted to refract light emitted from the electroluminescent cable according to a predetermined enhancement. Predetermined enhancements can include at least one of focusing, magnifying, diffusing, reflecting, or diverging light emitted from the electroluminescent cable. The elongated lens is a color-tinted lens can be adapted to introduce color to light emitted from the electroluminescent cable. In some aspects, the elongated lens can fully enclose the outer surface of the electroluminescent cable. Alternatively, an exposed portion of the outer surface of the electroluminescent cable can be provided that is not enclosed by the elongated lens, the elongated lens adapted to refract only light emitted at the portion of the outer surface enclosed by the lens.

In another general aspect, a flexible electroluminescent cable assembly, having an outer surface extending along a longitudinal dimension of the electroluminescent cable, is arranged on a substantially planar substrate. The outer surface of the cable assembly contacts the planar substrate along the longitudinal dimension of the outer surface of the cable assembly. An amount of liquid resin is deposited along the longitudinal dimension of the cable assembly so that the resin contacts both the outer surface of the cable assembly and a portion of the substrate near where the cable assembly contacts the substrate. The liquid resin is set to adhere the cable assembly to the substrate. The liquid resin, upon setting, forms an elongated lens extending along the longitudinal dimension of the electroluminescent cable and enclosing at least a portion of the outer surface of the electroluminescent cable, the elongated lens adapted to refract light emitted from the electroluminescent cable assembly.

Implementations can include one or more of the following features. Steps in manufacturing the light assembly can be performed by a computer-guided machine. Computer-readable manufacturing instructions can be identified defining characteristics for the light assembly, including dimensions and orientation of the light assembly. An adhesive can be applied to at least one of the cable assembly or substrate. Arranging the cable assembly onto the substrate can be guided according to the defined orientation for the light assembly. Depositing of liquid resin along the cable can be guided according to the defined characteristics. The liquid resin to be deposited can be metered according to the manufacturing instructions. Infrared light can be applied to set the deposited liquid resin. The substrate can be a flexible, non-porous substrate and the liquid resin, when set, can also be flexible. The substrate can be one of vinyl, plastic, wood, metal or other non porous material. The resin can be one of an epoxy or poly-urethane translucent resin.

In another general aspect, an elongated lens is machined having a cavity adapted to accept a length of flexible electroluminescent cable assembly, the elongated lens further adapted to refract light emitted from the electroluminescent cable assembly. The electroluminescent cable assembly is inserted in the cavity of the machined elongated lens. The machined elongated lens is adhered to a substantially planar substrate.

Implementations can include one or more of the following features. Machining the elongated lens can include forming the elongated lens in a mold. Machining the elongated lens can include grinding the elongated lens from a lens blank. The elongated lens can include a body and machining the elongated lens comprises grinding the cavity into the body according to dimensions of the electroluminescent cable assembly. The cavity can be a female receptacle for receiving the electroluminescent cable assembly and the elongated lens, upon insertion of the electroluminescent cable assembly, can encase the electroluminescent cable assembly.

In another general aspect, an electroluminescent cable is provided, having an outer surface extending along a longitudinal dimension of the electroluminescent cable. The cable includes a first electrode, a second electrode, and an electroluminescent core disposed between the first and second electrodes. The first and second electrodes are disposed so as to create an electromagnetic field between the first and second electrodes when a voltage is applied to the first and second electrodes. The electroluminescent core is disposed between the first and second electrodes adapted to emit light when excited by the electromagnetic field. A voltage is applied between the first and second electrodes to cause light to be emitted from the electroluminescent cable. Light emitted from the cable is enhanced through an elongated lens body extending along the longitudinal dimension of the electroluminescent cable. At least a portion of the outer surface of the electroluminescent cable is enclosed within the lens. The light is enhanced according to a characteristic of the lens body.

Implementations can include one or more of the following features. Enhancing light emitted from the electroluminescent cable can include at least one of refracting, focusing, magnifying, diffusing, reflecting, or diverging light emitted from the cable. Light emitted from the electroluminescent cable can be reflected off a reflective substrate to further enhance light emitted from the cable, wherein the substrate is attached to the elongated lens along the longitudinal dimension of the electroluminescent cable.

DESCRIPTION OF DRAWINGS

Like reference symbols in the various drawings indicate like elements.

DETAILED DESCRIPTION

A wire-like electroluminescent cable light can be encapsulated in or joined with an elongated lens to enhance the display of light from the wire-like electroluminescent light source. A thin, electroluminescent cable light assembly can emit light 360 degrees, isotropically along its length. These thin, energy efficient electroluminescent cables are capable of being used in a myriad of modern applications. For example, given their low profile and conservative power requirements, thin cable lights can be beneficially employed in fields such as portable lighting, vehicle and fleet graphics, architectural lighting, military lighting applications, and safety products. While the small diameter of cable light sources permits a low profile lighting solution, the narrowness of these light sources can result in meager light emission that is correspondingly thin and subtle, particularly at large distances, limiting the impact and application of a lighting solution implementing a thin cable light alone. In some implementations, the light emission of a thin cable can be enhanced, by refracting, focusing, magnifying, or dispersing light emitted by the cable through an elongated lens paired with the cable light, as shown, for example, in FIGS. 1, 3, 5A-5D. In additional implementations, light emitted from a thin cable light source can be further enhanced by applying a substantially planar, reflective backing to the cable. The backing can reflect light, emitted from the cable light, toward an intended target for the light, as well as, in some instances, further refract, color, and/or cooperate with an elongated lens to enhance the emitted light. Enhancements provided by a lens or reflective backing can improve the impact of light emitted by a thin cable light and thereby expand the range and effectiveness of lighting applications utilizing thin cable lights.

Figure 1:
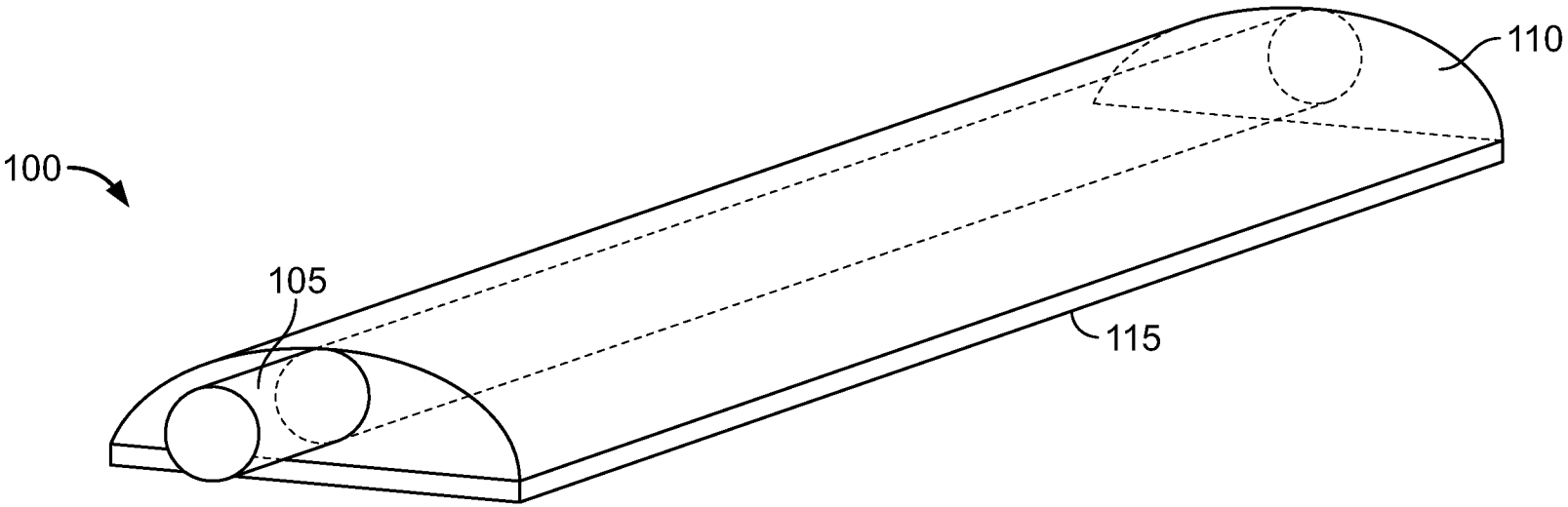
FIG. 1 is a perspective view of a light assembly.

FIG. 1 illustrates a perspective view of an example lighting assembly 100 that includes a thin cable light source 105, an elongated lens 110 corresponding to a length and orientation of the cable light 105, and a backing substrate 115 to which the light source 105 and lens 110 can be affixed. In some implementations, the cable light 105, and in some instances also the elongated lens 110, can be flexible, allowing the light assembly to be formed into non-linear shapes and designs. For instance, as shown in FIG. 2, an example sign 200 is shown that makes use of a light assembly 205, such as illustrated in FIG. 1, formed into the outline of the word "SIGNS." Light emission 210 from the light assembly 205 can enhance the overall visibility and impact of the sign, or a particular portion of the sign (e.g., a slogan, mark, logo, or message) that the sign's designer intends to illuminate and emphasize.

The low energy requirements of a cable light source, such as used in light assembly 205, can allow such high-impact enhancements to be added to portable signs and products requiring dynamic, portable power sources 215 such as batteries, solar cells, and other power sources. A cable light source, such as used in light assembly 205, may be powered by any suitable alternating current (AC) power supply, including direct current (DC) supplies converted to AC via an inverter. Additionally, enhancements of the light emitted from a lensed cable light assembly can be implemented by using a control module to switch and modulate the power supply to, for example, cause the cable light, or sections thereof, to flash or sequence to form a pattern or animation, automatically turn on or off in response to an event, fade, flash, or perform other effects.

Figure 2:
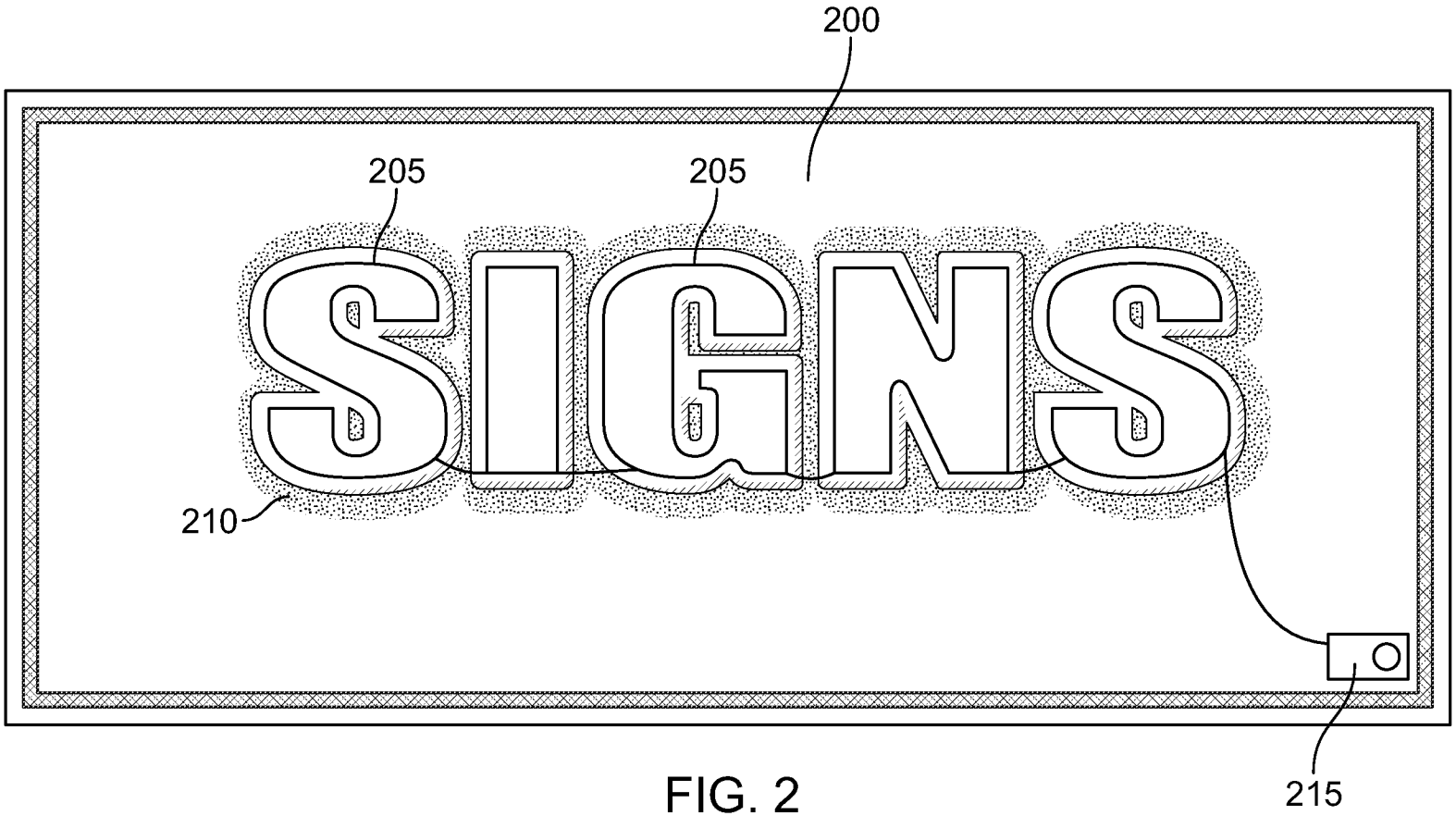
FIG. 2 shows an example sign including an example implementation of a light assembly.
Figure 3:
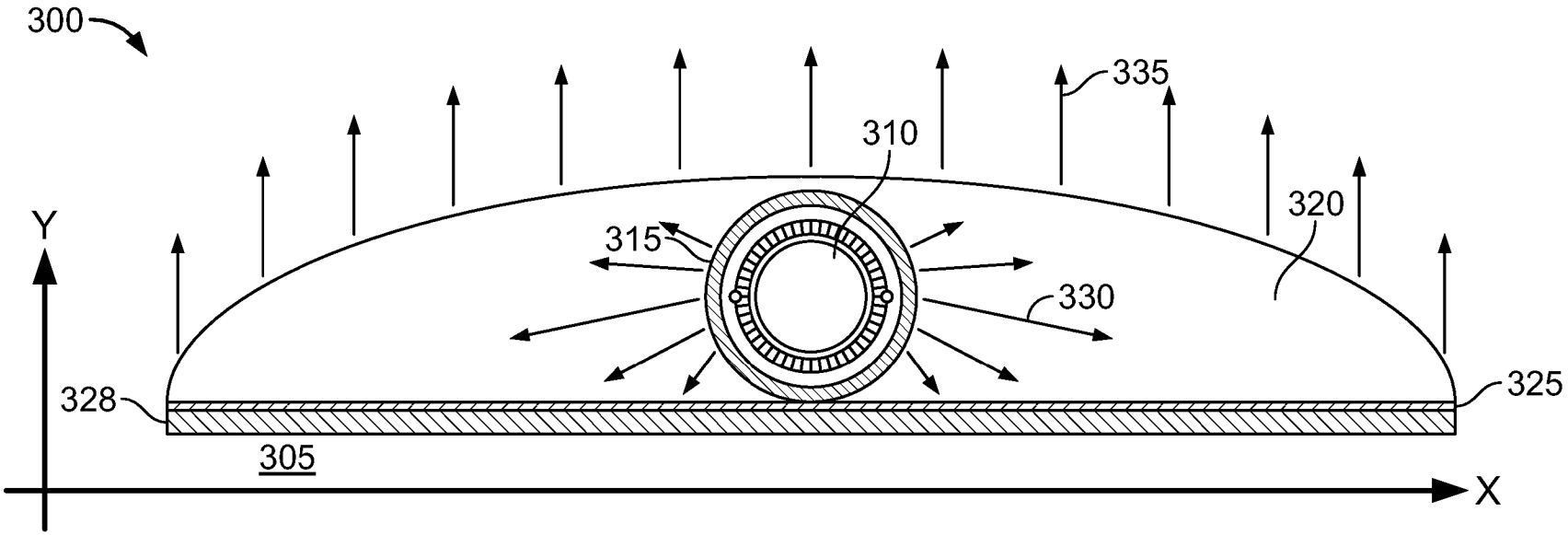
FIG. 3 is a cross-sectional view of an implementation of a light assembly.

FIG. 3 illustrates a detailed cross-sectional view 300 of an example light assembly 305, such as shown in FIGS. 1-2. FIG. 3 shows an example electroluminescent cable light 310 enclosed by a fully or substantially transparent, protective sheath 315. At least a portion of the outer surface of the cable light 310 (and sheath 315) are enclosed in an elongated lens 320. The lens 320 is attached to a backing substrate 325. The backing 325, along with the remaining light assembly 305, can be attached, as a unit, to a surface 328 of a sign, building, automobile, or other object. The backing substrate 325 can be reflective, allowing light 330 emitted from the cable light 310 to be reflected back into an intended viewing angle for the emitted light. Light 330 emitted by the cable light 310, is emitted radially, 360 degree from the cable light 310 along its length. The light 330 from the cable light 310, can be further directed and enhanced by the elongated lens 320. The lens 320 can refract, reflect, disperse, and magnify light 330 emitted from the cable light, so that light 335 emitted from the light assembly 305 is more visible and effective.

FIGS. 4A-4E illustrate example implementations of an electroluminescent cable light source 400. Generally, an electroluminescent cable light source 400 includes at least two electrodes 402, 404, oriented and displaced from the other so as to generate an electromagnetic field when a voltage is applied to the electrodes. Electroluminescent material, such as electrolumiphor or electrobioluminescent powders, can be used in an electroluminescent core 406 positioned with respect to the electrodes so as to be within an electromagnetic field generated between the electrodes 402, 404. The electromagnetic field excites the electroluminescent particles within the core 406 causing the particles to emit light.

Figure 4A:
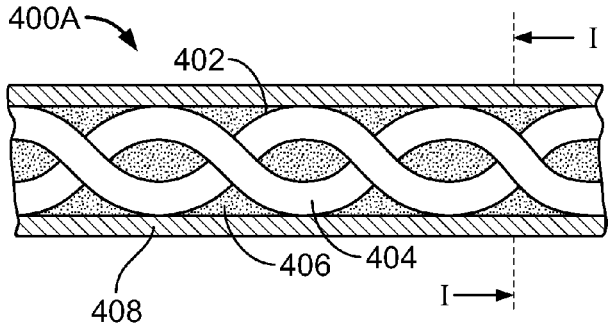
FIG. 4A is a longitudinal cross-section view of a first implementation of a electroluminescent cable.
Figure 4B:
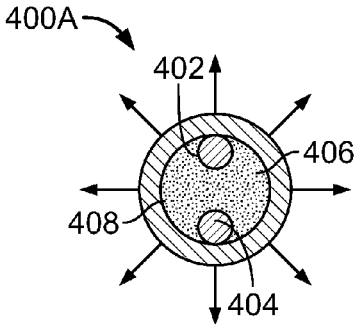
FIG. 4B is a cross-sectional view flow, along plane I-I, of the electroluminescent cable of FIG. 4A.

FIGS. 4A and 4B illustrate a first example of an electroluminescent cable light source 400A. FIG. 4A shows a side, cross-sectional view of an electroluminescent cable light source 400A. Electrodes 402 and 404 are relatively high gauge wire (e.g., AWG 25-40) oriented as a twisted, helical pair. In some instances, the wire electrodes can include an insulating layer. The wire electrodes 402, 404 are wound to form a helical hollow 405, as shown in the cross-sectional view of interface I-I of FIG. 4B. Disposed within this hollow 405, and between the electrode wire 402, 404, is the electroluminescent core 406. The electrodes 402, 404 and core 406 can be enclosed and sealed within a transparent sleeve 408. In some implementations, the core 406 and sleeve 408 can be made to be flexible, allowing the cable light source to be bent, twisted, curved, and oriented to form letters, words, logos, images, and other shapes. For instance, the sleeve 408 can be made of flexible, transparent polyvinyl chloride, e.g., 0.5-0.6 mm thick.

Figure 4C:
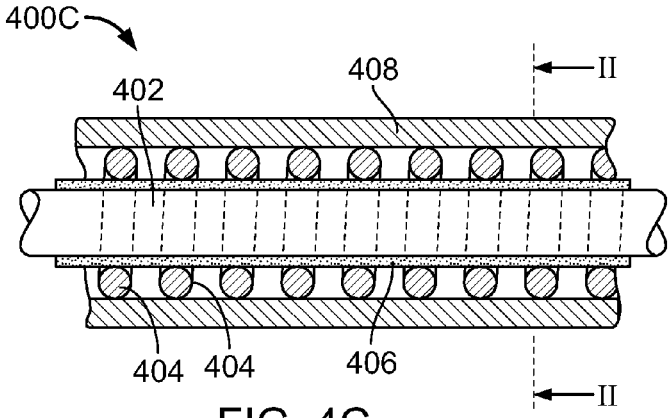
FIG. 4C is a longitudinal cross-section view of a second implementation of a electroluminescent cable.
Figure 4D:
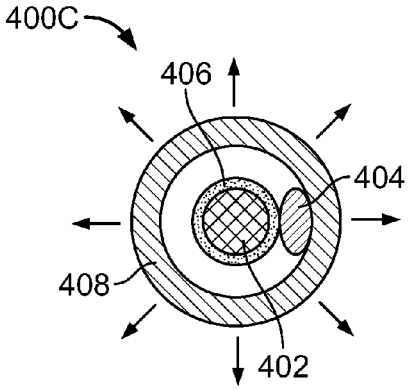
FIG. 4D is a cross-sectional view flow, along plane II-II, of the electroluminescent cable of FIG. 4C.

FIGS. 4C and 4D illustrate an example of an alternative electroluminescent cable light source 400C, incorporating a central electrode 402. The central electrode, can be insulated, and have an additional layer of electroluminescent material coating its outer surface. This electroluminescent layer forms the electroluminescent core 406. This layer can be quite thin, within a thickness of 0.1-0.2 mm. Wound around the central electrode 402 and core 406 is the second electrode 404, composed of high gauge wire. A sleeve 408 can be wrapped or pulled over the core 406 and electrodes 402, 404 to protect and seal the assembly. The central electrode 402 can be a medium gauge wire that, together with the electroluminescent layer 406, is nonetheless flexible allowing the electroluminescent cable 400C to be formed and reformed into one of a variety of shapes or orientations.

Figure 4E:
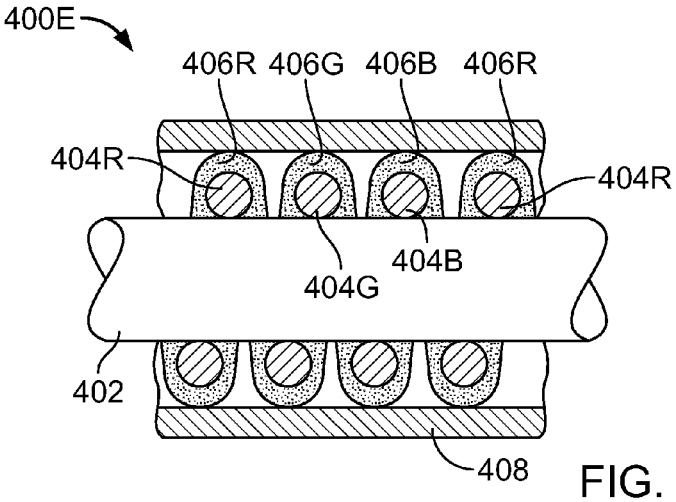
FIG. 4E is a longitudinal cross-section view of a third implementation of a electroluminescent cable.

FIG. 4E illustrates yet another example of an electroluminescent cable light source 400E. In the example of FIG. 4E, the electroluminescent cable 400E is adapted to emit multi-colored light. This can be achieved by providing a plurality of electrodes specifically dedicated to activating the emission of light of a particular color. For instance, as shown in FIG. 4E, three high gauge wire electrodes, 404R, 404G, 404B, corresponding to red, green, and blue (RGB) light emission, can be coiled around an insulated, central electrode wire 402. Each of the RGB electrode wires 404R, 4046, 404B can be coated or encased in electrolumiscent material 406R, 406G, 406B that emits light of a corresponding color when excited by an electromagnetic field. The electroluminescent material surrounding the RGB electrodes 404R, 404G, 404B form three electroluminescent cores 406R, 406G, 406B, one for each of red, green, or blue light. Voltage can be selectively applied between the central electrode 402 and one or more of the color-specific electrodes to emit one or more colors of light from the electroluminescent cable 400E. For instance, voltage applied between the electrodes 402 and 404R would produce red light, whereas voltage applied between the central electrode 402 and both electrodes 404R and 404B would produce violet light.

An electroluminescent core, such as described in the examples of FIGS. 4A-E, can be composed of any one of a number of available or future electroluminophor powders. Many electroluminophor powders can be excited through a wide range of AC voltages, including frequencies between 50-20,000 Hz and amplitudes from 100-300 V. In some instances, a concentrated, phosphor-based powder can be used. In other examples, a biolumniphor can be used. In some implementations, a dielectric binding can be mixed with the luminophor to produce the electroluminescent core of the cable light. Many of these materials possess the benefit of low power light emission. Additionally, many electroluminophor powders emit "cool" light, in other words, efficient light emission with relatively low, accompanying heat emission. The color emitted by the powder depends on the type, materials (e.g., dyes), and luminophor concentration used. Such phosphor-based cable light sources can consume, for example, upwards of 10%-30% less energy than neon lights, rope LEDS, and incandescent lights.

One of the benefits of thin electroluminescent cables, such as illustrated in FIGS. 4A-E, is their low profile and flexibility, some cables having an overall diameter of less than 3 mm. A thin electroluminescent cable is lighter, cooler, and less prone to protrude when used in applications (e.g., signs) demanding a low profile light source. A hairline light source, such as a thin electroluminescent cable, is limited, however, in its independent ability to produce high profile light effects, particularly at a distance. In one aspect, as shown for example in FIG. 3, an elongate lens 320 can be paired with the electroluminescent cable 310 in order to enhance the light emitted from the cable 310. The enhancements made possible by a lens structure 320 are dictated by the material, form, and geometry of the lens 320 itself, as well as the form and properties of the substrate backing 325 upon which the lens 320 is mounted. The lens 320 can assume a number of geometries and dimensions in order to provide the desired magnification and enhancements for the light emitted from the cable 310.

Figure 5A:
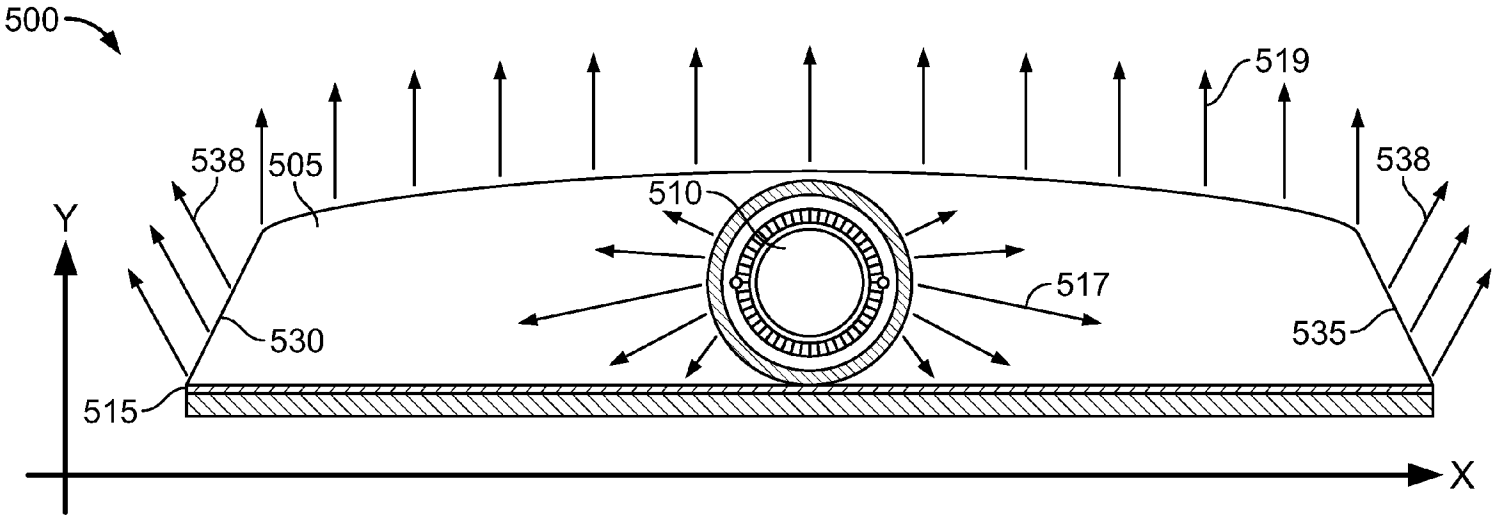
FIG. 5A is a cross-sectional view of a second implementation of a light assembly.
Figure 5B:
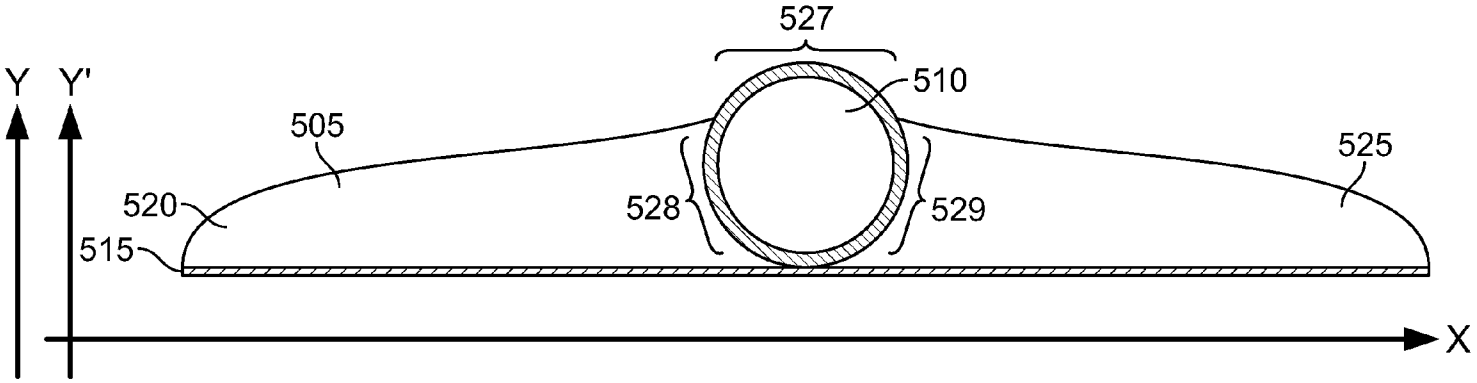
FIG. 5B is a cross-sectional view of a third implementation of a light assembly.
Figure 5C:
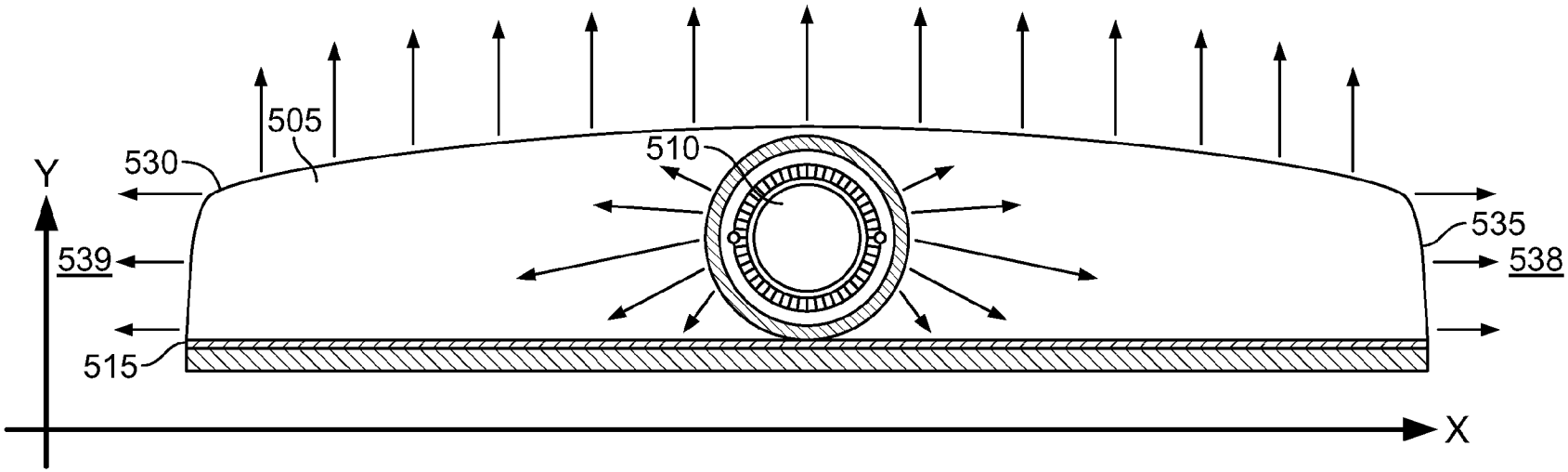
FIG. 5C is a cross-sectional view of a fourth implementation of a light assembly.

FIGS. 5A-C illustrate some example elongate lens configurations that can be paired with a thin electroluminescent cable to enhance light emitted from the cable. For instance, FIG. 5A shows the cross-section 500 of one alternative lens design. As in FIG. 3, the lens 505 used in light assembly 500 generally adopts a dome-like, plano-convex configuration. Doming the electroluminescent cable 510 in an elongate, plano-convex lens 505 can create a convex lens effect magnifying, refracting and reflecting the electroluminescent light. Additionally, a plano-convex lens configuration can enhance and enlarge the image (or light) below the lens. In instances where the lens 505 has a bottom surface showing a reflective, colored, or printed substrate 515, the lens 505 also magnifies the color and images on, and light reflected from, the portion of the substrate beneath the lens 505. A magnifying, convex lens, such as shown in the examples of FIGS. 3 and 5A, can effectively cause light 517 emitted from the thin cable light 505 to appear to be light 519 emitted from a larger source corresponding to the dimensions of the elongated lens 505.

As shown in FIGS. 3 and 5A, it can be advantageous to use a lens with an oblong cross-section, where the width X of the lens 505 is (or approaches) an order of magnitude larger than the diameter of the cable light 510, allowing light to be dispersed and reflected by the lens across its width X. This effect can be further enhanced and aided by a reflective substrate 515 positioned beneath the lens 505. In some implementations, a similar effect can be achieved using a width X of the lens 505 that is larger than the diameter of the cable light 510 by significantly less than an order of magnitude (e.g., the width X is two times the diameter of the cable light 510).

Adopting an oblong lens configuration can further preserve the benefits of low-profile electroluminescent wire lights by adding very little, if any depth Y to the overall light assembly. Indeed, in some examples, such as shown in FIG. 5B, the lens 505 only extends to partially cover the outer surface of the cable light 510. As in FIG. 5B, the depth of the lens may be less than the diameter of the cable light 510. In some implementations of the example of FIG. 5B, the partial lens 505 may be manufactured as two or more pieces (e.g., 520, 525), or as a single piece (as in FIG. 6D). Considering an example where the intended viewing angle of light emitted from the cable light 510 is 180 degrees (i.e., parallel to and facing the substrate 515), there may be less benefit to providing a lens over the top, or foremost, portion 527 of the cable light, as light emitted from this portion 527 is already substantially directed and focused toward the intended target. In such instances, material and manufacturing costs of the lens can be substantially minimized by concentrating lens material near the sides 528, 529 of the cable light, in order to focus the lens's 505 function on the re-direction of light emitted largely parallel to or in the opposite direction of the intended viewing angle. In some implementations, the depth Y of the lens 505 can extend only to 50% of the diameter Y' of the cable light 510, while in other instances the lens 505 depth Y can be greater than the diameter Y' of the cable light 510.

As shown in FIG. 5A, one alteration that can be made to lens 505 is the inclusion of angled edges 530, 535. The ends 530, 535 of lens 505 can be manufactured, molded, or cut to be edged, or capped, rather than rounded, as in FIG. 3. The flat, edged lens ends 530, 535 can be angled at a particular degree in order to realize a particular effect at or near the lens ends 530, 535. For instance, edging the lens ends 530, 535 can concentrate light diverted by the lens 505 at these edged ends 530, 535 and cause more light 538 to shine at the periphery of the lens 505. Additionally, the angle of the edges 530, 535 can be selected to dictate the angle of light 538 emitted at the edges 530, 535. For instance, in the alternative embodiment shown in FIG. 5C, the angle of the edged lens ends 530, 535 can be cut to approximate 90 degrees, so as to divert light more particularly toward the periphery of the lens 505.

Figure 5D:
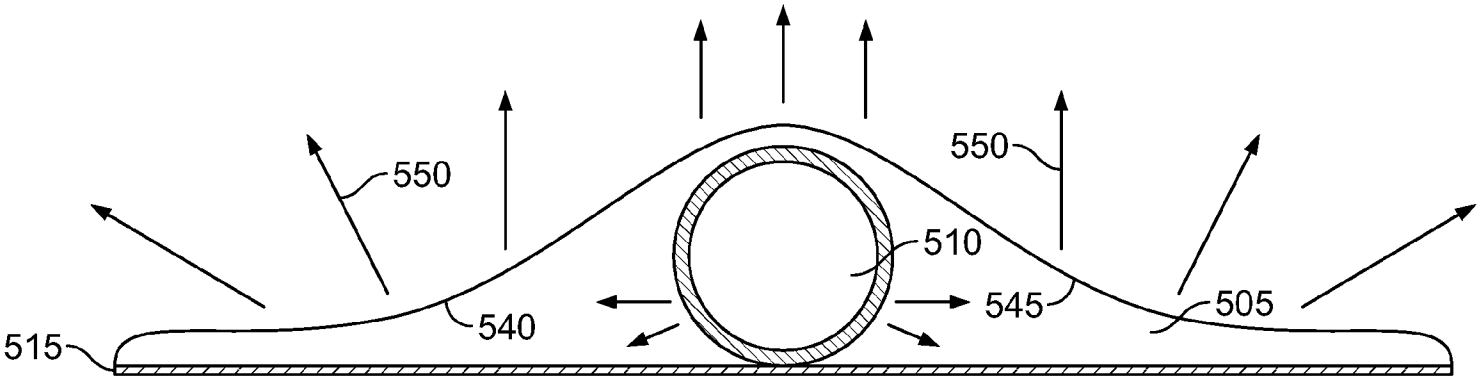
FIG. 5D is a cross-sectional view of a fifth implementation of a light assembly.

Other light enhancements can be realized through the lens 505 design, including those shown in the example of FIG. 5D. FIG. 5D illustrates an example employing a lens 505 having concave lens sections 540, 545. Concave lenses cause light emitted from the cable light 510 (and reflected from the substrate 515) to be diverged, producing a dispersed, hazy light 550 emission, on the periphery of the central cable light 510. Other lens orientations can also be constructed and employed to achieve specialized, complex lighting effects using the cable light, including orientations combining one or more of the aspects shown and described above.

Lenses used in connection with a thin cable light-based assembly can also include lenses of various materials. For instance, colored lenses can be employed in order to color light emitted from a cable light. Some implementations, such as lenses formed out of epoxys and poly-urethane resins, can be used in order to provide for a lens that is able to flex, bend, and be formed, with the flexible cable light, into various shapes and orientations. Lens material (and dimensions) can also be selected to provide enhanced support and protection for the cable light source. For instance, a lens can be used that fully encloses the cable light in order to provide additional support, water-proofing, or abrasion protection for the thin cable light. Additionally, the material selected for the lens can be selected for its protective properties. For instance, a semi-flexible or rigid lens can be used for its enhanced physical protective properties. To realize a semi-flexible or rigid lens, Acrylic, Lexan®, or other translucent plastic or glass can be used for the lens. In some instances, a lens material can be selected for its anti-corrosive, ultraviolet protective, or anti-glare properties. Protective lens material can be incorporated in the body of the lens itself or applied as a coating to the outer surface of the lens.

As noted above, selection of a substrate for use with the lens and cable light can serve to further enhance and provide additional effects for the lensed cable light assembly. As discussed, a substrate (and substrate material) can be employed exhibiting reflective properties to reflect and redirect light emitted by the cable light source toward the target. The reflective surface of the substrate can be colored, so as to color light reflected from the reflective surface. Indeed, in some implementations, printed images of varying colors can be used in the substrate, the lens enhancing (e.g., magnifying, distorting, etc.) the printed image as well as light reflected from the image. Materials and media, used for the reflective substrate, can also vary in degree of reflectivity. Depending on the application, substrates having higher or lower reflectivity can be selected to produce the desired lighting effect.

Figure 7A:
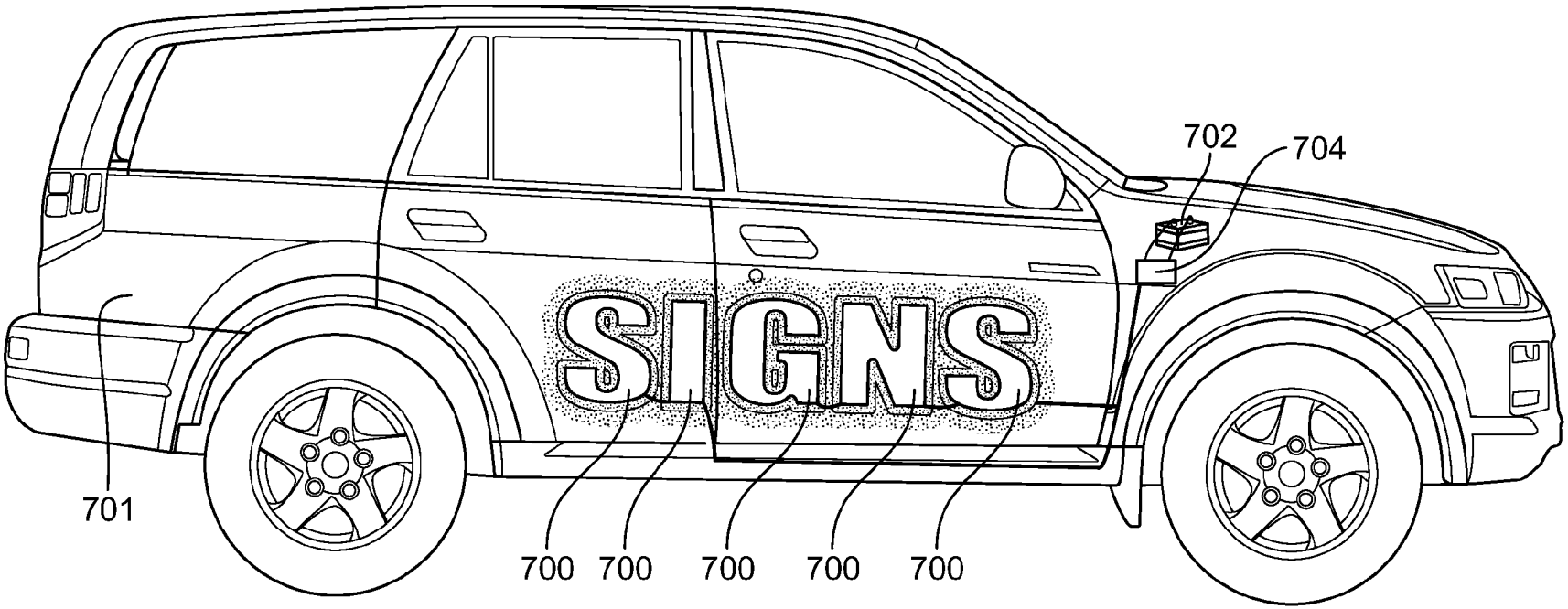
FIG. 7A shows an automobile wrapper that includes an example light assembly.

In some implementations, a substrate can be selected based on the ease or convenience of using the substrate in connection with a particular lighting application. For instance, as shown in FIG. 7A, a lamp assembly, such as described in any of FIG. 1, 3, or 5A-D can be implemented using a thin and flexible material capable of being formed around and applied to a curved, or otherwise uneven purpose, such as a vehicle wrap. Vehicle wraps are synthetic, printed sheets that are adhered to a vehicle, such as a car, truck, or van. Vehicle wrap sheets can be printed with large-scale images, logos, and lettering allowing a vehicle "wrapped" in the sheets to be transformed into a mobile billboard displaying the printed design. In one example, a synthetic vehicle wrap panel, made of vinyl or a similar material, can serve as the substrate of a lensed cable light assembly. In an alternative embodiment, a thin substrate can be used for the cable wire lamp that is, itself adhered to an object (e.g., a vehicle wrapper or a vehicle surface itself).

The substrate of a cable light assembly, such as the assembly 305 of FIG. 3, can be permanently adhered or otherwise attached to the lens 320 and cable light 310 structure. For instance, an epoxy or other adhesive can be applied to permanently affix the substrate to the lens, and in some case also the cable light 310. In other instances, the lens 320 material itself can bind and adhere to the substrate without the use of additional adhesive (as described below). In some implementations, attaching the substrate 325 serves to seal the lamp assembly 305, protecting, for example, the cable light from exposure to water or other liquids. The substrate can also serve as the base for affixing the completed cable light assembly 305 to another object, such as a sign, article of clothing, or vehicle. For example, the substrate (and thereby the light assembly) can be affixed by glue, Velcro, magnets, or other adhesive methods. Indeed, in some instances, the substrate itself can have the adhesive mechanism built-in to the substrate. For instance, the substrate can include an adhesive backing or be constructed from a magnetic sheet for easy application to an object's surface.

Figure 6A:
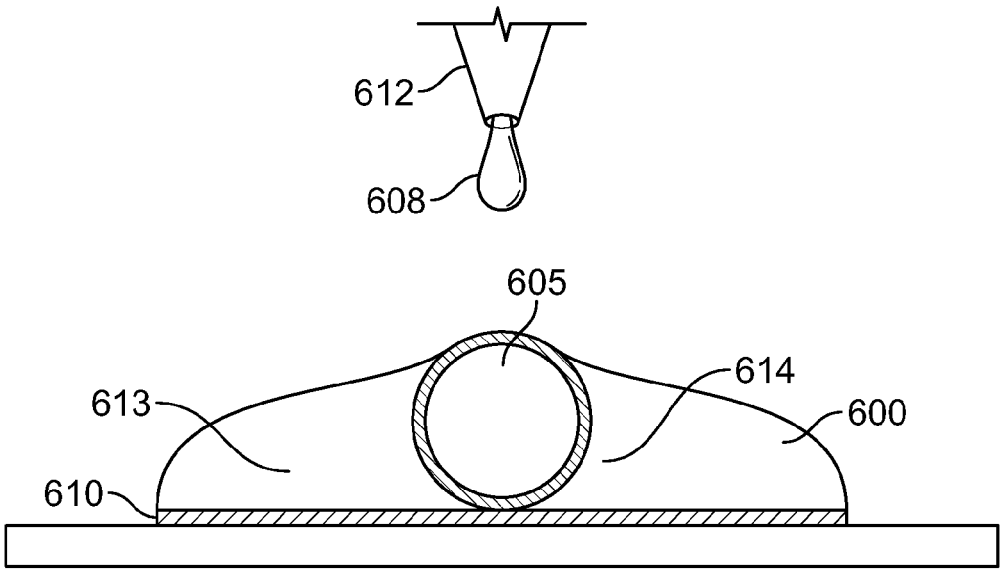
FIG. 6A illustrates the assembly of an example light assembly.

FIG. 6A shows an example of a process for making an elongate lens 600 for use with a thin electroluminescent cable light 605. Liquid lens material 608, such as an epoxy, polyurethane, or any other translucent resin material, is deposited on or around the cable light 605, using for example resin doming tools and machinery. When the resin dries or sets, it then forms a transparent (or semi-transparent) lens for light emitted from the cable light 605. Setting of the resin can be assisted, for example, using infrared light, heat, cooling, and other techniques. In some examples, the liquid lens material 608 is deposited on a substrate 610, binding together the lens 600, cable light 605, and substrate 610 in a single step. In other examples, the cable light 605 is first adhered or otherwise secured to the substrate, before the liquid lens material 608 is deposited on the cable light 605 and substrate 610 to form the lens 600. This can be a useful technique, when the cable light lamp assembly 615 is to be formed into a non-linear shape, such as the word outline shown in FIG. 2. One or more strands of cable light 605 can be first arranged on the substrate 610 in the desired shape or orientation and adhered to the substrate to prevent the cable light 605 from being moved or otherwise disturbed, after the desired shape has been set, during depositing of lens material 608 on the substrate 610 and cable 605.

In some implementations, a substrate 610 material and/or lens material can be selected on the basis of its surface energy and ability to adhere to the lens material 608. For instances, the substrate 610 can be pre-cut, for example using a die cut, laser, or knife, into the general, two-dimensional shape (i.e., dimensions along the X axis) desired for the lens 600, prior to depositing lens material 608. The lens material 608, having the requisite surface tension to build up the desired depth Y of the lens 600, can then be deposited on the surface of the substrate 610. Provided that the surface energy of the substrate material is high enough to allow the lens material 608 to wet its surface, the lens material 608 spreads until it reaches the cut edges of the substrate 610, forming a dome that encompasses the width of the substrate 610. In some instances, the resulting lens, given the lens material's surface tension, will result in the creation of domed, three-dimensional lens, such as shown in FIG. 3. In other instances, through the selection of the proper amount and type of lens material 608 (e.g., possessing higher or lower surface tension), lenses can be constructed with other dimensions. For instance, using the method of FIG. 6A, lenses can be constructed with dimensions similar to those shown in FIGS. 5B and 5D.

Figure 6B:
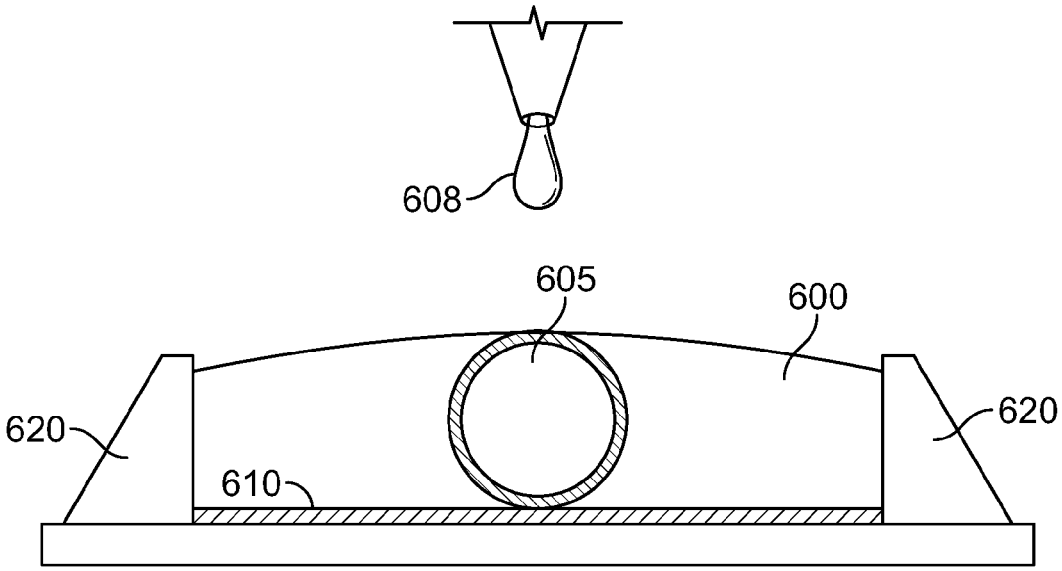
FIG. 6B illustrates the assembly of a second example light assembly.

Additionally, as shown in FIG. 6B, a mold or dams 620, can be used together with the method described in connection with FIG. 6A, to influence and guide the liquid lens material 608 during depositing, as well as help the material 608 set in a particular, predetermined geometry for the lens 600. Using a technique similar to that shown in FIG. 6B, a lens with angled or capped edges can be manufactured, similar to those shown in FIGS. 5A and 5C. In other instances, the shape of the lens 600 resulting from the deposited lens material 608, can be further customized by cutting, grinding, or otherwise processing the lens material 608, before or after it has set, to achieve the desired geometry and dimensions for the lens 600.

The steps or processes described above in connection with the FIG. 6A can be automated or performed manually. For instance, one or more of these steps and processes can be automated through the use of computer-controlled equipment, such as automated cutting or liquid depositing machinery. For instance, in one implementation, computerized numerical controlled (CNC) machine tools can be employed, automated using CAD. As an example, a vinyl substrate 610 can be first loaded on top of a loading bed of a CNC tool. The substrate 610 can be secured to the loading table using, for instance, and vacuum table. Registration marks can be printed on the substrate 610, the marks capable of being read by the CNC machine to match the substrate sheet 610 to a particular operation program or program parameters guiding the operation of the CNC machine. These registration marks can be, for example, a scannable code, such as a bar code. In one example, the CNC machine, can manufacture a lensed cable light assembly according to a program, specified by a registration mark, according to measurements and specifications (e.g., a layout for the assembly, the gauge of cable light wire 605, etc.) input into or otherwise accessed by the program.

In one example, the program can begins by automatically trimming or cutting the substrate 610 to remove excess material from the substrate 610, or to cut the substrate 610 to a predetermined shape or outline. The CNC machine can then select the appropriate wire type to be used in the lensed cable light assembly. For instance a particular color or gauge of cable light may be identified. In some instances, a particular wiring head tool may be activated, designated for applying the selected cable type to the substrate 610. The CNC machine can lay the cable light 605 to follow a pre-determined design pattern, such as a letter or shape. In some instances, glue or other adhesive can be first applied to the substrate in advance of the cable wire 605, the adhesive applied according to the desired design pattern for the cable 605. In lieu of or in addition to adhesive applied to the substrate 610, adhesive can be applied to a surface of the cable 605 to attach the cable 605 to the substrate 610. Pressure can then be applied to the cable 605 to adhere the cable to the substrate 610.

With the wire in place, the CNC machine itself, or another CNC machine, can proceed to apply the lens material 608 to the cable light 605 and substrate 610. This may involve switching the head tool used to lay cable or adhesive, to a head 612 adapted to mix and apply lens material 608, such as resin. As in previous steps, the CNC machine can apply the lens material 608 according to the shape or design of the overall assembly. The type of material 608 to be used for the lens can be selected according to a CNC machine program (e.g., to control lens color, opacity, flexibility, etc.). Additionally, the amount of material 608 beaded onto the cable light 605 can also be controlled to realize a desired width and depth of the resulting lens 600. For instance, a user or program can instruct the CNC machine that the lens is not to enclose the wire, such as in the example of FIG. 5B. The amount of lens material 608 dispensed from the head 612 can be automatically metered so that an exact area of substrate 610 is covered in the lens material 608. The amount may be determined by the area of the substrate, the desired depth of the lens 600, the surface tension of the liquid lens material 608, as well as the surface energy of the substrate material 610 used. The CNC machine program can include a software module adapted to calculate this metered amount to be dispensed given a particular area, substrate material, and lens material as inputs. The lens material dispensing head 612, in some instances, can apply material along two paths: an inside fill path 613 and an outside edge path 614. By following two paths, it creates resin, and lenses, on both sides of the electroluminescent cable light 605. In other instances, lens material 608 can be applied to both sides 613, 614 of the wire simultaneously, for example, by using multiple heads 612 or by applying the lens material 608 to the center of the cable light. Once all of the lens material 608 has been applied, the CNC vacuum table can then move to an infrared drying chamber, or other drying assembly, allowing the lens material to set. Moving the assembly to a drying area also serves to free other portions of the CNC manufacturing system for subsequent processing, allowing a second vacuum table to be loaded for processing.

The materials used in connection with the process of FIGS. 6A-B can include properties discussed above that serve to further enhance light emitted from the cable light 605. For instance, the substrate 610 can be a plastic, vinyl or other non-porous material that includes a reflective, colored, or metalized surface. An image, design, pattern or logo can be further printed upon the substrate 610 prior to the application of lens material on the substrate. Additionally, lens material can be selected based on its functionality as a lens (e.g., the index of refraction for the material), its color, opacity, and or rigidity when dried.

As an alternative to the techniques described in connection with FIGS. 6A and 6B, FIGS. 6C-E illustrate an alternative technique including the machining of a finished lens body 600 that can then be combined with a corresponding cable light 605 and substrate 610 to construct a light assembly 615. A lens body 600 can first be manufactured, for example, by encapsulating, injection molding, or molding transparent plastics or glass into a domed, convex, concave, or hybrid lens configuration. Other machining methods can be employed, such as machine cutting, laser cutting, sandblasting, or water cutting the lens body 600 from a block, sheet, or other piece of translucent material, or lens blank. The lens body 600 can be manufactured to take the overall shape of the lamp assembly to be constructed from the lens 600 and cable light 605, such as the word outline shown in FIG. 2. For example, a lens can be manufactured, through a mold, to form a rigid or semi-rigid lens in the desired shape of a word, logo, or image.

Pre-machining a lens body allows for the manufacture and design of lens bodies with precise dimensions and geometry. Computer-aided design (CAD) techniques can be used in connection with many modern machining processes to model, design, and plan a lens design before fabricating it. In addition, manufacturing processes, such as laser and water cutting, and injection molding, can employ automated computer controls to cut, grind, and form the desired lens body 600 (or mold of the lens body design) according to precise specifications. In addition to forming the dimensions and geometry of the functional lens body 600, manufacturing the lens body can also include providing a groove, notch, channel, or encapsulation tube for inserting or mating the lens body 600 with the corresponding cable light 605. For instance, a groove, notch, channel, or encapsulation tube can be cut, ground, etched, or bored into the lens body before, after, or while the other dimensions and geometry of the lens are formed. In some instances, a groove or channel for the cable light can be included in the mold of the lens, allowing the entire, completed lens body to be manufactured through a single reverse or injection mold.

Figure 6C:
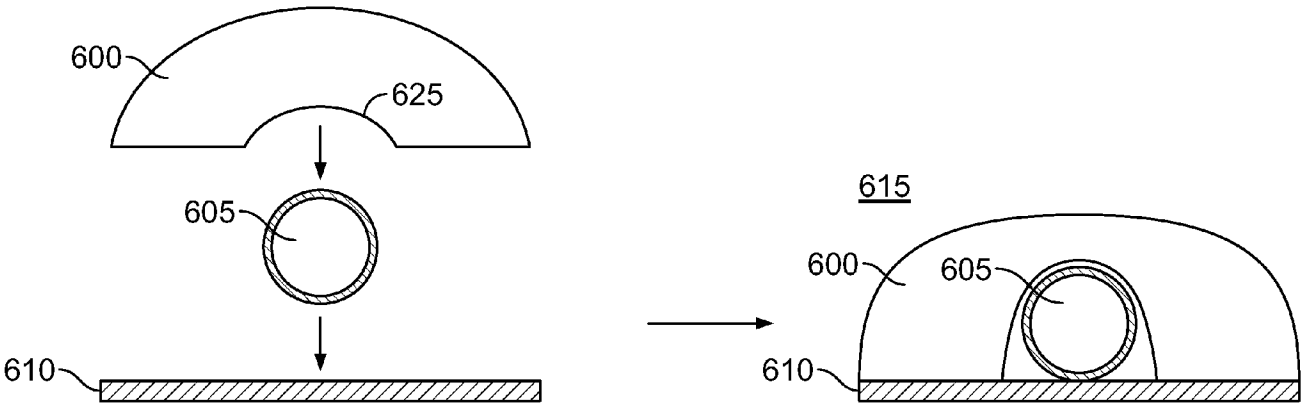
FIG. 6C illustrates the assembly of a third example light assembly.

FIG. 6C illustrates the assembly of a lensed cable light product 615 from a cable light 605 and pre-manufactured elongated lens body 600. As shown in FIG. 6C, with at least the basis of the lens body constructed, additional steps can be employed to assemble a lamp assembly incorporating the lens 600. For instance, in some implementations, the lens 600 has been manufactured to include a groove or channel 625 with dimensions suitable for accepting a cable light 605. In some implementations, upon positioning the cable light within the channel 625, additional transparent resin or adhesive can be applied to the channel and/or cable light 605 to permanently secure or seal the cable light within the channel 625. This additional resin, plastic or other liquid can also serve to make light transmission from the cable light 605 to the lens 600 more efficient. In other implementations, the dimensions of the channel 625 and cable light 605 are such that the cable light can be inserted into the channel by securely snapping the cable light 605 into place within the lens channel 625. Other mechanisms can also be used, beside channeling, to secure a cable light 605 to an elongated lens body 600, including the use of adhesive, Velcro, tape, or other suitable attachment mechanisms.

After positioning the cable light within the channel, in some embodiments, a substrate backer 610 can be adhered to the lens 600 as well as the cable light 605. This substrate 610 can be attached with screws, glue, resin, or some other adhesive mechanism. As in other examples described above, this substrate backing 610 can be reflective, colored, or have printed designs on its surface to enhance light distribution and emission from the cable light 605. In some implementations, this substrate backer 610 can also serve to seal the electroluminescent cable light 605 in the lens 600. In other limitations, the backer 610 can be removable to allow for access to the cable light 605 to allow for its repair or replacement.

Figure 6D:
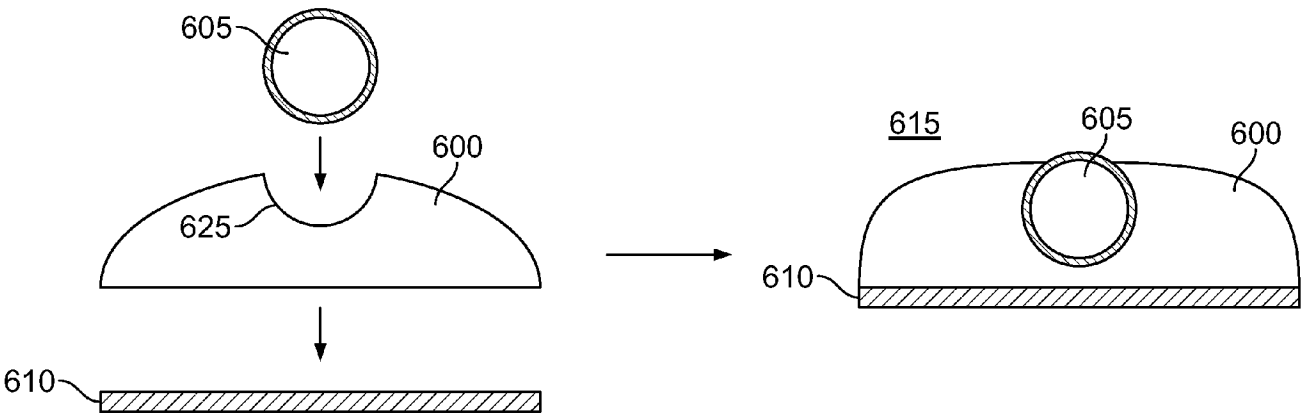
FIG. 6D illustrates the assembly of a fourth example light assembly.

FIGS. 6D and 6E show assembly of alternative implementations of a lensed cable light product 615 using a pre-manufactured lens 600. FIG. 6D shows an implementation of the prefabricated lens 600 that provides for the cable light to be inserted into a cavity 625 at the top of the lens 600, as opposed to the underside as shown in FIG. 6C. Such an arrangement allows for the construction of a lens body similar to that in FIG. 5B that minimizes the use of lens material while providing effective enhancement of light emitted from portions of the cable light not originally directed toward the intended viewing angle.

FIG. 6E shows another example of the assembly of a lensed cable light assembly 615 using a pre-manufactured lens 600. In this example, a tubular channel 625 has been included or bored into the lens body 600, with dimensions permitting the insertion of the cable light 605 into the channel 625. A substrate backing 610 can be affixed to or integrated on the underside of the lens 600. In some implementations, a liquid, such as a resin, can be introduced into the channel with the cable light 605 in order to improve light transfer from the cable light 605 to the lens 600. The liquid can be set or sealed within the channel 625. While several suitable channel example have been shown and described, other channel configurations can also be adopted and are within the scope of this disclosure.

Given the low profile, light weight, and energy efficiency of some cable light lamp assemblies, such as those described above, a light assembly including a cable light—and corresponding elongated lens can be used in a variety of commercial applications. For example, as shown in FIG. 7A, a lensed cable light assembly can be attached to the surface of a vehicle 701 as an ornamental design or advertisement. In some implementations, as described above, the light assembly 700 can be attached to or integrated in a vehicle wrap adhered to the vehicle. The light assembly 700 can be powered by the battery 702 of the vehicle through the use of an inverter 704.

Figure 7B:
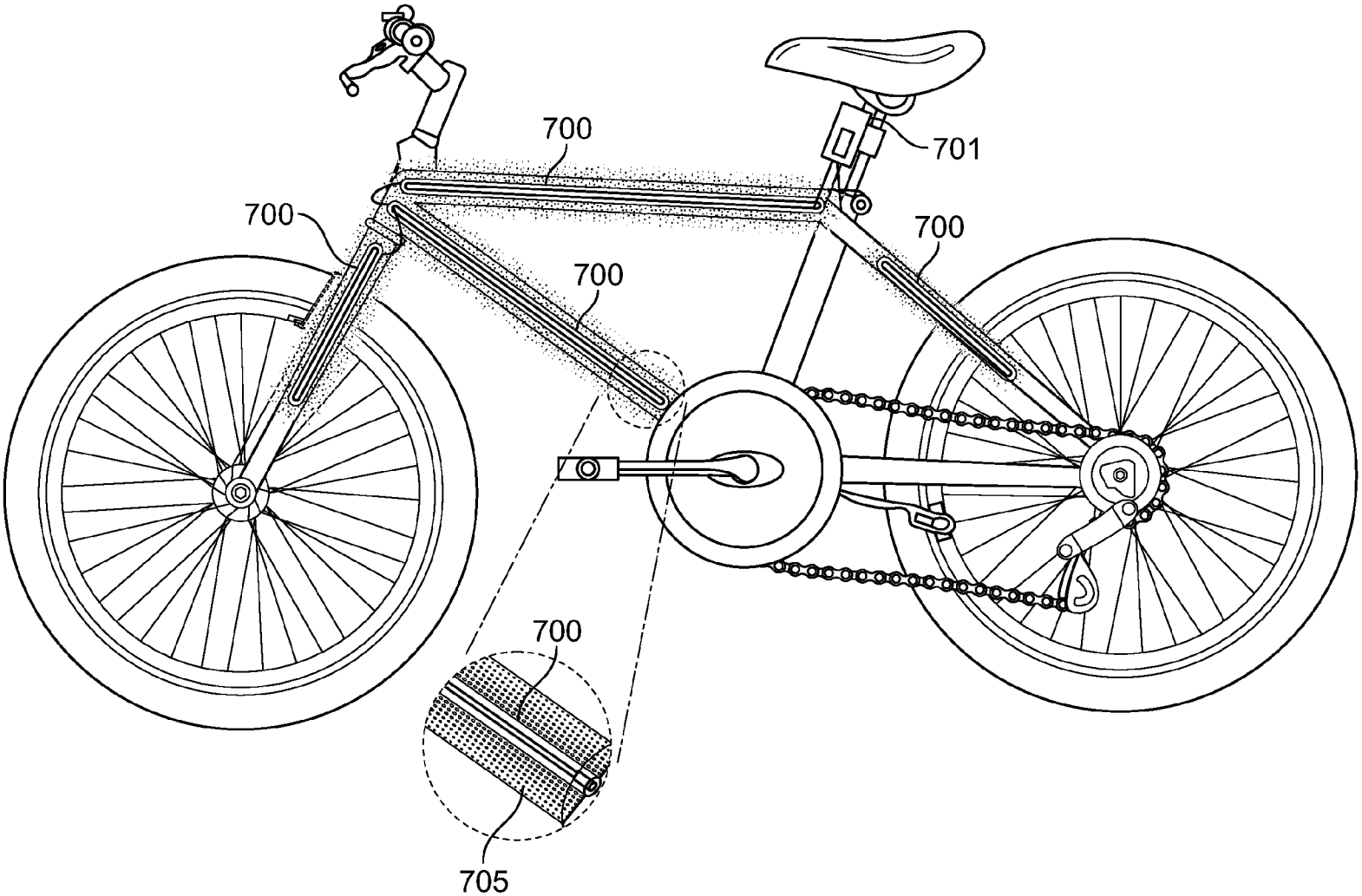
FIG. 7B shows a bicycle that includes an example light assembly.

In another example, as shown in FIG. 7B, a light assembly 700 can be attached to, and used in connection with a bicycle. Lensed cable light assemblies can also be applied to comparable personal transportation devices such as scooters, skateboards, rollerblades, and Segway™ scooters. The light assembly can be used to highlight a message or brand name associated with the bicycle (or other device), as well as serve a safety function, illuminating the bicycle frame for high-visibility during nighttime use. The use of the elongated lens 705 in the light assembly helps to realize this high-visibility, enhancing light projected from the cable light. Moreover, by maximizing the visibility of light emitted from the cable light through the use of a corresponding elongated lens and/or reflective backer, less electroluminescent cable is needed than would otherwise be required in applications using a cable light alone.

Figure 7C:
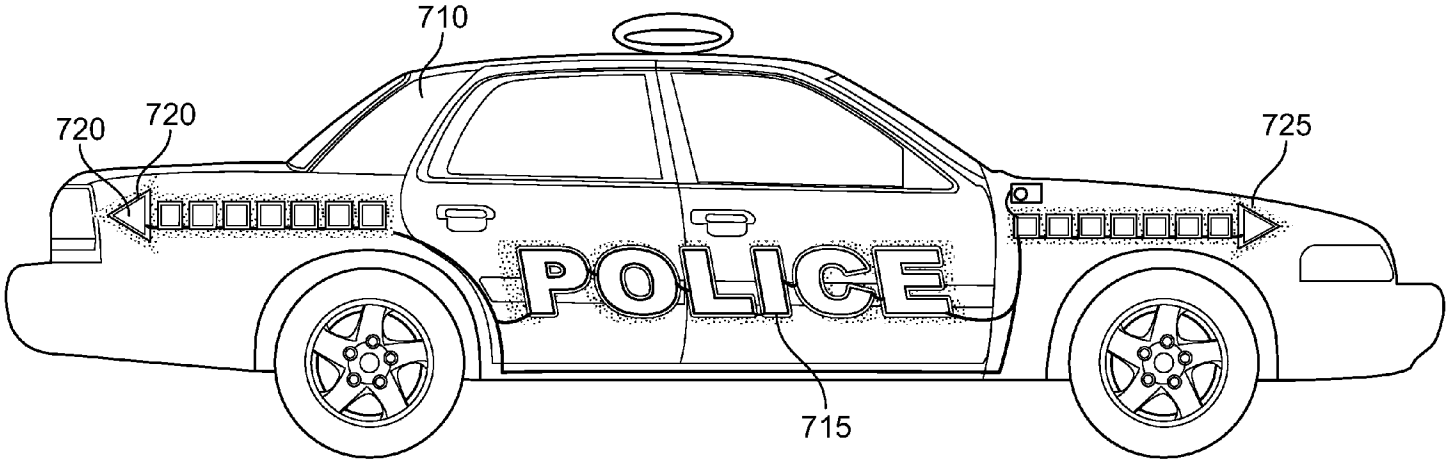
FIG. 7C shows a side view of a police car that includes an example light assembly.
Figure 7D:
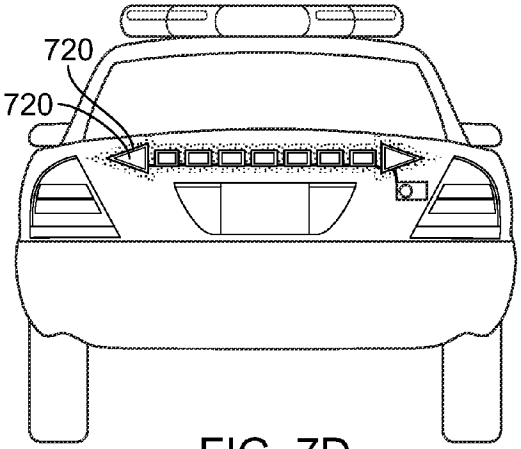
FIG. 7D shows a rear view of a police car that includes an example light assembly.
Figure 7E:
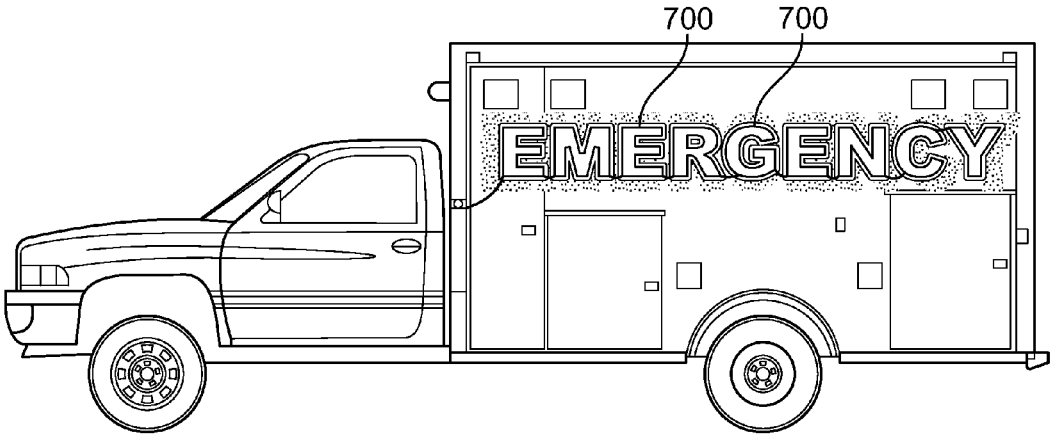
FIG. 7E shows a side view of an ambulance with emergency lighting that includes an example light assembly.
Figure 7F:
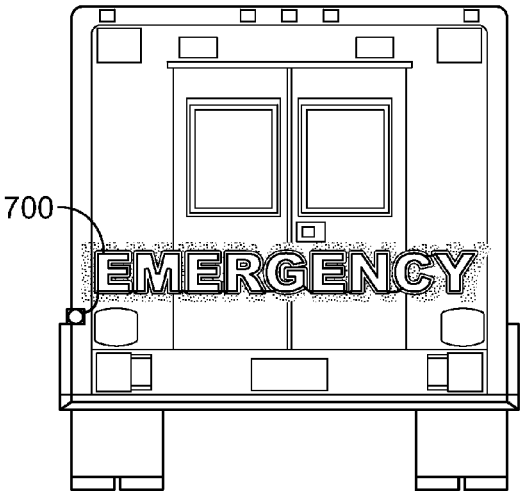
FIG. 7F shows a rear view of an ambulance with emergency lighting that includes an example light assembly.
Figure 7G:
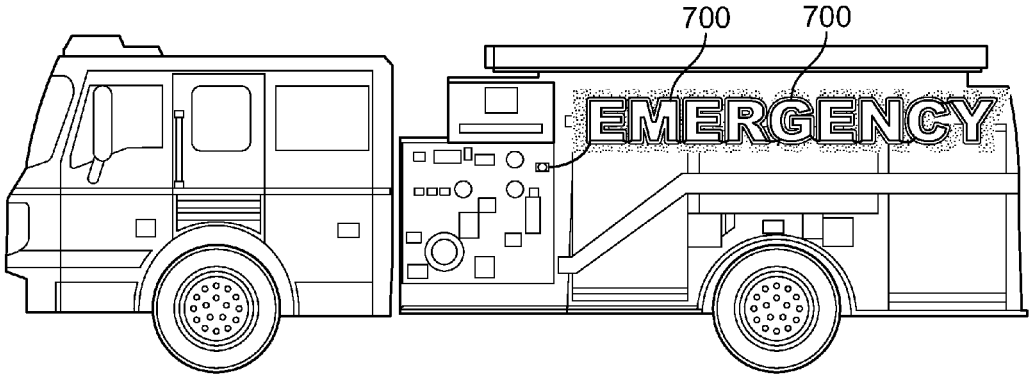
FIG. 7G shows a side view of a fire engine with emergency lighting that includes an example light assembly.
Figure 7H:
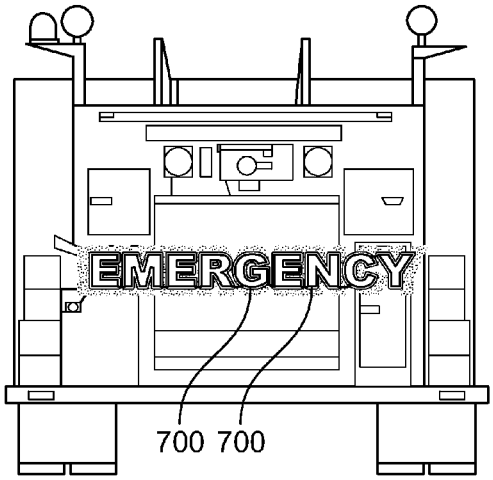
FIG. 7H shows a rear view of a fire engine with emergency lighting that includes an example light assembly.

Lensed cable light assemblies can also be applied in safety applications, including on emergency vehicles, in order to warn, direct, or alert the public through lighted, visual messages or signals. For instance, FIG. 7C shows a first view of a police car that includes lensed cable light assemblies 715, 720, 725 to illuminate a side panel 710 of the car with an assembly 715 shaped in the outline of "POLICE." Further lensed cable light assemblies 720, 725 can be employed near and on the rear of the squad car (see also FIG. 7D) that function as animated, lighted direction arrows used, for example, to direct traffic around an accident or pedestrian traffic following a special event. The segments of the arrows 720, 725 can be controlled by a programmable multi-channel sequencer that selectively turns on and off sections of the lensed cable light assembly so as to create an animated effect. Lensed cable light assemblies can be similarly employed on other safety vehicles including an ambulance (as illustrated in FIGS. 7E-F) and fire engine (FIGS. 7G-H).

Figure 7J:
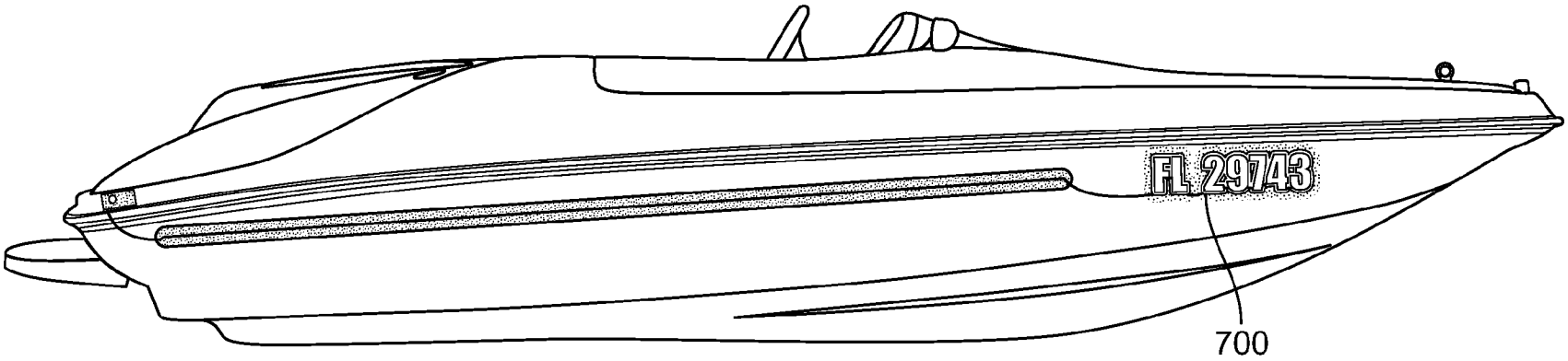
FIG. 7J shows a watercraft that includes an example light assembly.

In addition to land-based vehicles, lensed cable light assemblies can also be applied to air- and water-based vehicles. For example, in some implementation of the lensed cable light assembly, the elongated lens can serve the duel purpose of both enhancing emitted light and sealing the sensitive cable light from exposure to water. Water-resistant, lensed cable light assemblies 700 can be affixed to and used in connection with marine craft such as boats, yachts, and personal water craft (e.g., jet-skis), as shown in FIG. 7J. Lensed cable lights 700 can serve to light the profile of the water craft to enhance safety during nighttime use, as well as find application in connection with watercraft used by safety, customs, navy, and law enforcement operators.

Figure 7M:
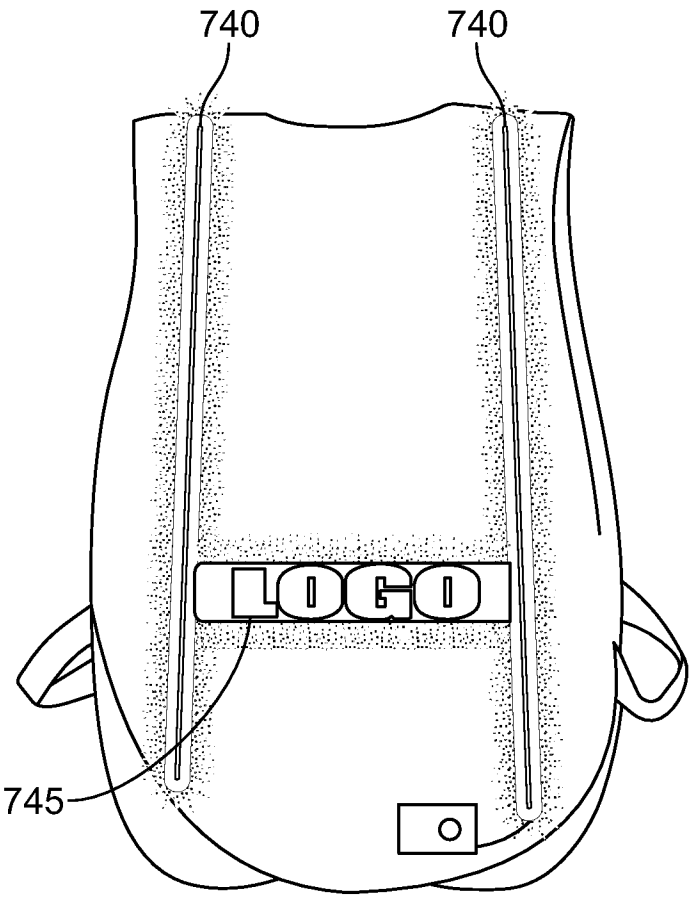
FIG. 7M shows a back view of the safety vest of FIG. 7L.
Figure 7L:
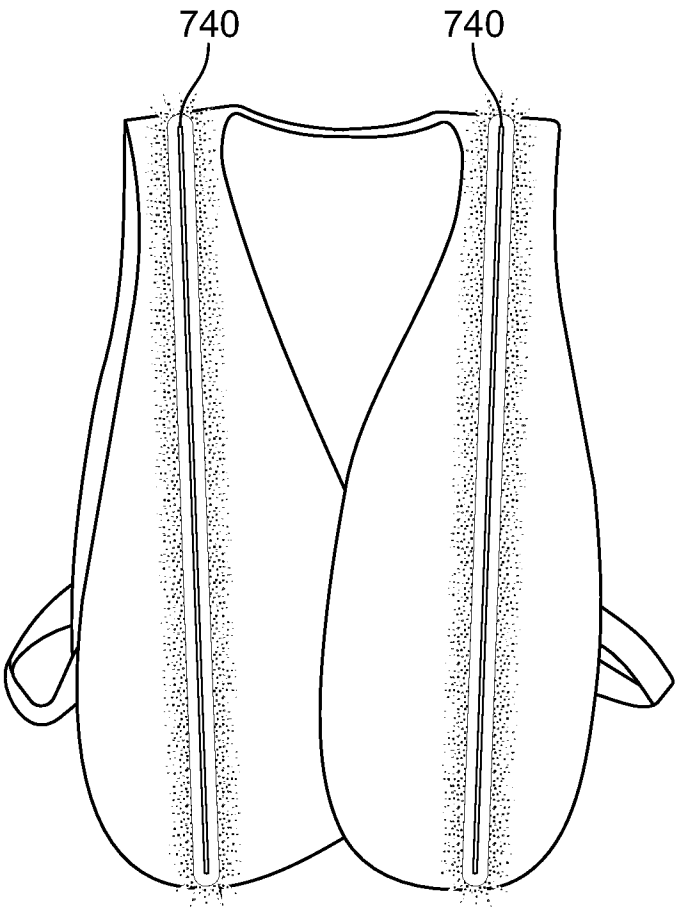
FIG. 7L shows a front view of a safety vest that includes an example light assembly.
Figure 7N:
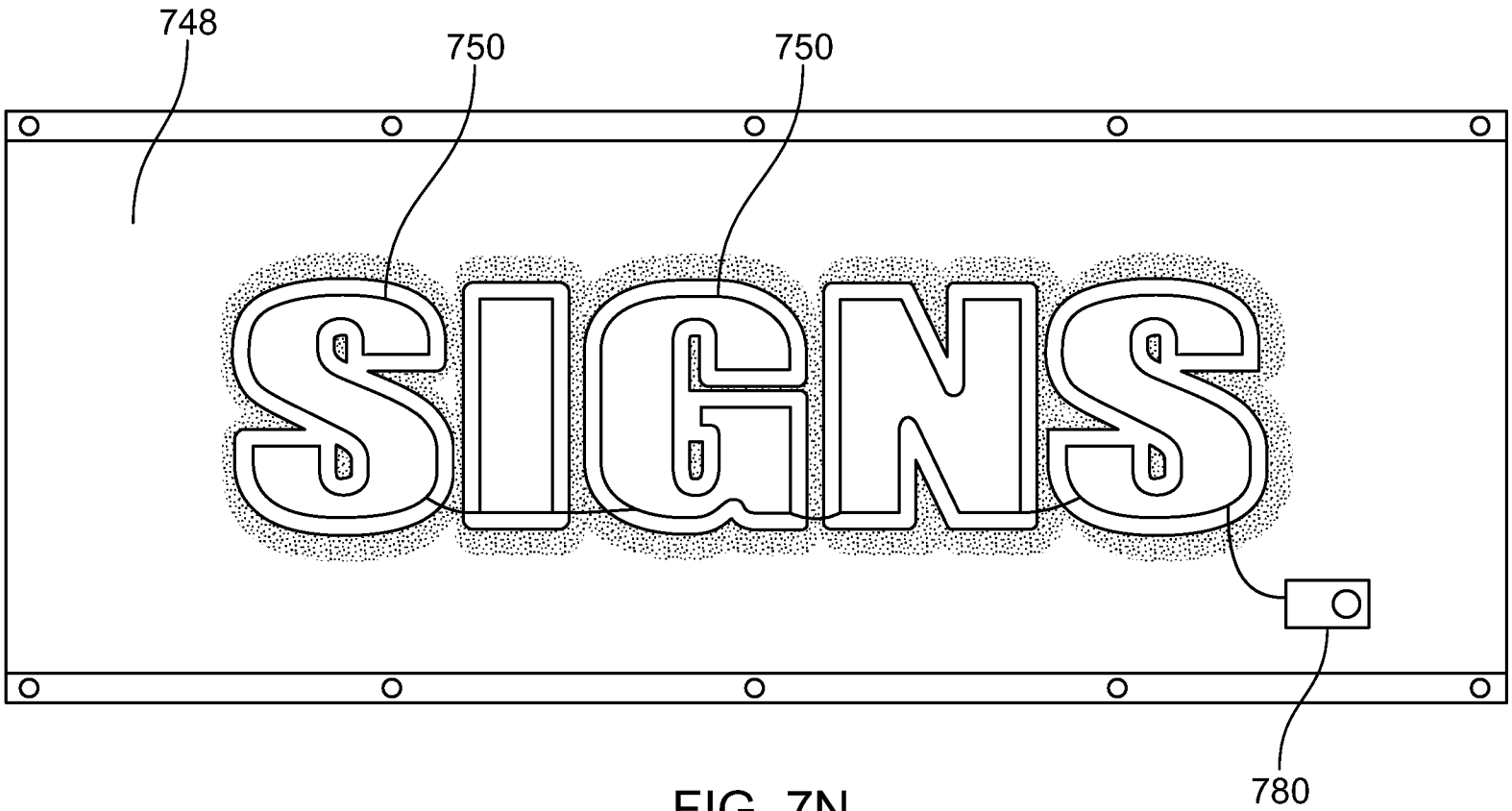
FIG. 7N shows a portable banner that includes an example light assembly.
Figure 7Q:
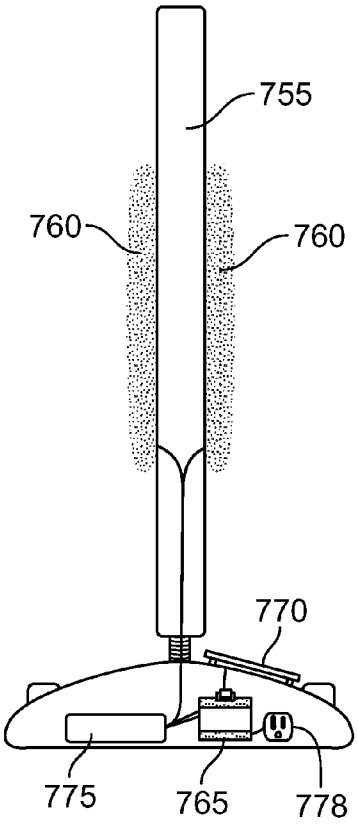
FIG. 7Q shows a rear view of a portable sign that includes an example light assembly.
Figure 7P:
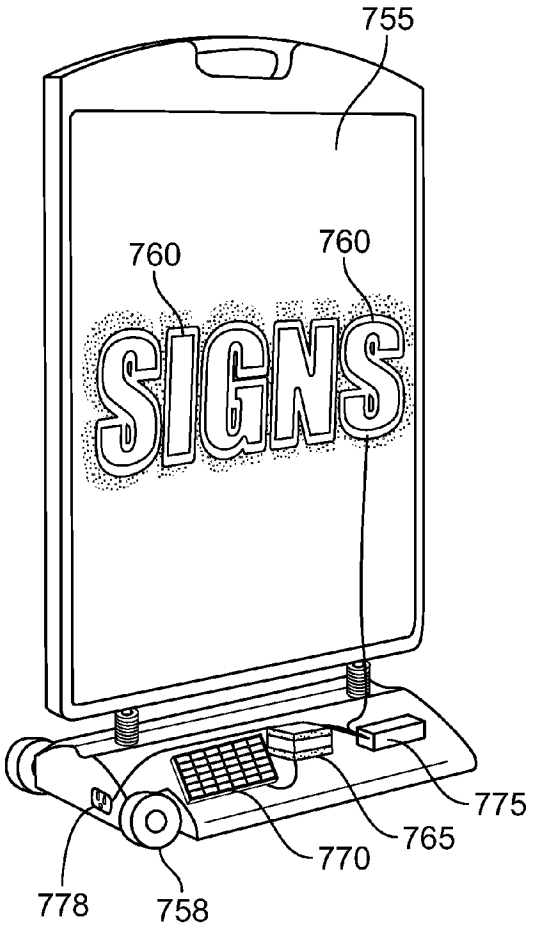
FIG. 7P shows a front view of a portable sign that includes an example light assembly.
Figure 7R:
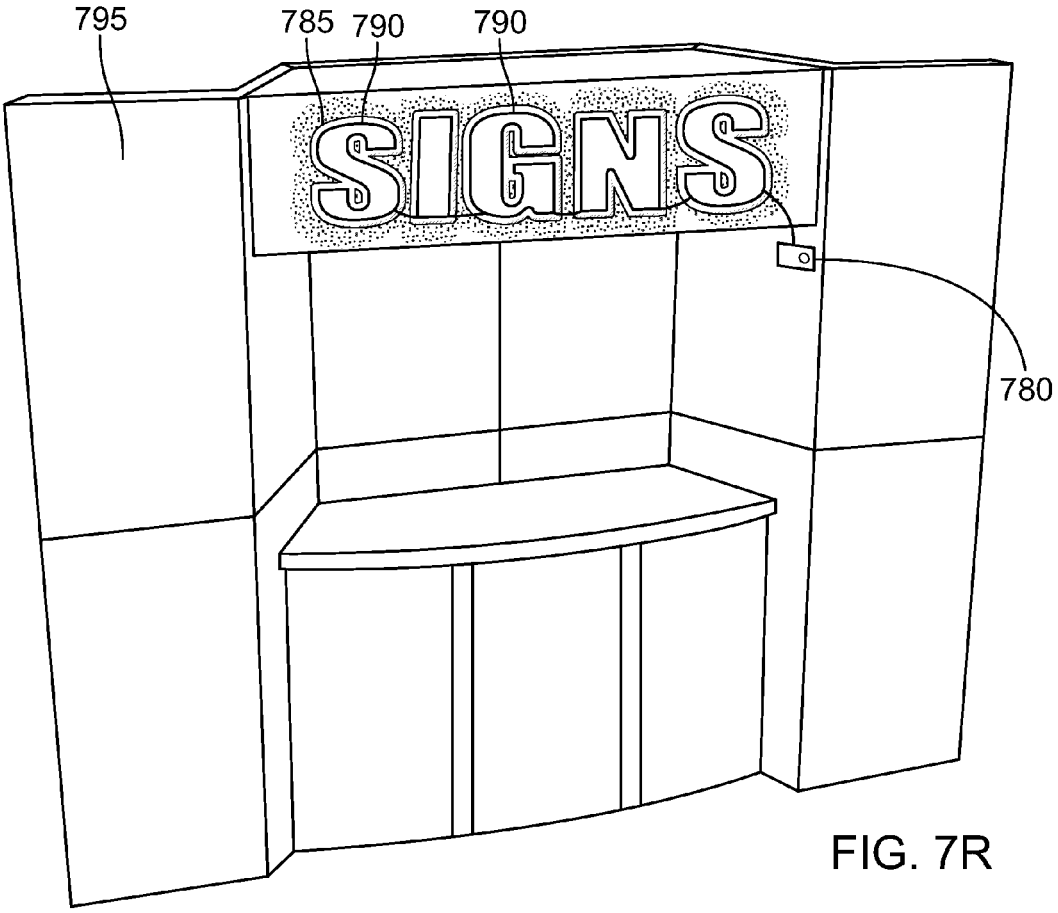
FIG. 7R shows a tradeshow booth that includes an example light assembly.
Figure 7K:
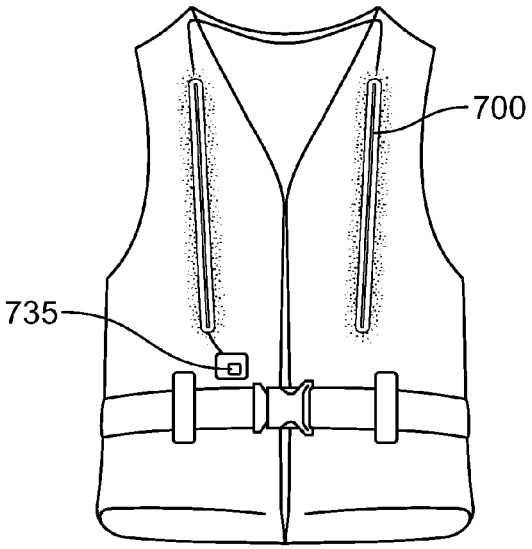
FIG. 7K shows a front view of a life vest that includes an example light assembly.

The water-resistant nature of some lensed cable light assemblies can find further application in connection with other water-related activities, such as scuba diving, open-water swimming, surfing, and water skiing. For instance, as shown in FIG. 7K, an example life vest is shown that uses a water resistant, lensed cable light assembly 700. The life vest can be used by water skiers, for example, in order to increase their visibility during periods of low light or boat traffic. Additionally, as shown in the example of FIG. 7K, the life vest can include a water-triggered, DC power supply 735, including an inverter, that turns on when the power supply switch comes in contact with water (e.g., during a water-based evacuation from an aircraft or passenger ship, or when a passenger falls from a boat or skis).

The lensed lighting assemblies described above can also find application applied to articles of clothing. A lensed cable light assembly can be included, for example, to enhance the ornamental design of a jacket or pair of shoes. More practical applications can also be realized, for example, by applying a lensed cable light assembly on an article of safety clothing designed to grab the attention of others. For instance, as shown in FIGS. 7L-M, a safety vest can include a lensed cable light assembly 740 that improves or replaces reflective striping commonly used in safety vests, as well as lighted lettering 745 to denote that the vest's wearer is a law enforcement officer or municipal worker, for example. Lensed cable light assemblies can also find use in other clothing applications where the visibility of the wearer is important, such as hunting or children's Halloween costumes.

The lightweight and energy efficient nature of lensed cable lighting systems, such as described above, allow for wide deployment of the system in connection with applications requiring flexibility and portability. For instance, as shown in FIGS. 7N-R, lensed cable lights can be applied to and used in connection with mobile advertisements, banners, and other signage where portability is desirable. FIG. 7N illustrates an example of a portable banner 748 incorporating a lensed cable light display 750 of the word "SIGNS." In that some lensed cable light displays can be flexible, a lighted banner 748 incorporating such flexible light assemblies can be rolled or folded for easy storage and transportation. In another example, FIGS. 7P-Q show an example portable sign 755, including wheels 758 and multiple power supply options 765, 770, 775, 778. Given the power efficiency of lens cable lighting systems, such as the assembly 760 used in the portable sign of FIGS. 7P-Q, several power sources may be suitable to power the light assembly, including DC sources such as a rechargeable battery pack 765 or solar panel 770, connected to an inverter 775. Of course, a 120/240 volt AC power supply can also be used, for example, by plugging-in 778 the portable sign to power the lighting assembly 760 or recharge a DC power source 765. Signage using a lensed cable light assembly can be used within a variety of contexts, from window advertisements to billboards. For instance, FIG. 7R shows an example of a battery 780 powered sign 785 incorporating a lensed cable light assembly 790 for a tradeshow booth 795.

As described, the versatility, flexibility, power efficiency, and low-profile dimensions of lensed, cable light systems can find wide utility in applications ranging from signs and advertisements, to architectural applications, military lighting applications, safety equipment, safety accessories, entertainment, theater, and sporting equipment, or any other environment or market where added visibility promotes safety or adds another dimension to a product's design.

While this specification contains many implementation details, these should not be construed as limitations on the scope of the subject matter described or of what may be claimed, but rather as descriptions of features specific to particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. For instance, combinations of any of the elongated lens configurations and characteristics described can be combined, including combinations of the various implementations of cable light sources, reflective backers, and lighting control circuitry described.

Similarly, while operations are depicted in the drawings implying a particular order, this should not be understood as requiring that such operations be performed in the particular order shown or in sequential order, or that all illustrated operations be performed, to achieve desirable results. In addition, operations described as being completed by hand or through the use of suitable mechanical or computerized equipment, should not be understood as requiring that such operations should be performed in this manner or using a particular device, tool, material, or functionality.

What is claimed is:

1. A method of manufacturing a light assembly, the method comprising:

arranging a flexible electroluminescent cable assembly, having an outer surface extending along a longitudinal dimension of the electroluminescent cable, on a substantially planar substrate, wherein the outer surface of the cable assembly contacts the planar substrate along the longitudinal dimension of the outer surface of the cable assembly;

depositing an amount of liquid resin along the longitudinal dimension of the cable assembly so that the resin contacts both the outer surface of the cable assembly and a portion of the substrate near where the cable assembly contacts the substrate; and setting the liquid resin to adhere the cable assembly to the substrate, wherein the liquid resin, upon setting, forms an elongated lens extending along the longitudinal dimension of the electroluminescent cable and enclosing at least a portion of the outer surface of the electroluminescent cable, the elongated lens adapted to refract light emitted from the electroluminescent cable assembly.

2. The method of claim 1, wherein the method steps are performed by a computer-guided machine, the method further comprising:

identifying computer-readable manufacturing instructions defining characteristics for the light assembly, including dimensions and orientation of the light assembly;

applying an adhesive to at least one of the cable assembly or substrate;

guiding the arrangement of the cable assembly onto the substrate according to the defined orientation for the light assembly;

guiding the depositing of liquid resin along the cable according to the defined characteristics, wherein the liquid resin deposited is metered according to the manufacturing instructions; and applying infrared light to set the deposited liquid resin.

3. The method of claim 1, wherein the substrate is a flexible, non-porous substrate and the liquid resin, when set, is flexible.

4. The method of claim 3, wherein the substrate is one of vinyl, plastic, wood, metal or other non porous material.

5. The method of claim 1, wherein the resin is one of an epoxy or poly-urethane translucent resin.

6. A method of manufacturing a light assembly, the method comprising:

machining an elongated lens having a cavity adapted to accept a length of flexible electroluminescent cable assembly, the elongated lens further adapted to refract light emitted from the electroluminescent cable assembly;

inserting the electroluminescent cable assembly in the cavity of the machined elongated lens; and adhering the machined elongated lens to a substantially planar substrate.

7. The method of claim 6, wherein machining the elongated lens comprises forming the elongated lens in a mold.

8. The method of claim 6, wherein machining the elongated lens comprises grinding the elongated lens from a lens blank.

9. The method of claim 6, wherein the elongated lens includes a body and machining the elongated lens comprises grinding the cavity into the body according to dimensions of the electroluminescent cable assembly.

10. The method of claim 6, wherein the cavity is a female receptacle for receiving the electroluminescent cable assembly and the elongated lens, upon insertion of the electroluminescent cable assembly, encases the electroluminescent cable assembly.

* * * * *